US008672744B1

(12) United States Patent
Gronkowski et al.

(10) Patent No.: US 8,672,744 B1
(45) Date of Patent: Mar. 18, 2014

(54) ADJUSTABLE WAGERING GAME SYSTEM SOCIAL INTERACTIVITY CONFIGURATION

(75) Inventors: Timothy T. Gronkowski, Chicago, IL (US); Andrew C. Guinn, Chicago, IL (US); Scott A. Massing, Lincolnwood, IL (US); Noel S. Steere, Chicago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 273 days.

(21) Appl. No.: 13/209,989

(22) Filed: Aug. 15, 2011

Related U.S. Application Data

(60) Provisional application No. 61/374,015, filed on Aug. 16, 2010.

(51) Int. Cl.
*A63F 9/24* (2006.01)

(52) U.S. Cl.
USPC ..... 463/25; 463/26

(58) Field of Classification Search
USPC ..... 463/25, 26
See application file for complete search history.

(56) References Cited

U.S. PATENT DOCUMENTS

| | | | | |
|---|---|---|---|---|
| 6,902,478 | B2 | 6/2005 | Mcclintic | |
| 7,618,319 | B2 | 11/2009 | Casey et al. | |
| 7,722,466 | B2 | 5/2010 | Rothschild | |
| 7,883,403 | B2 | 2/2011 | Low et al. | |
| 7,931,531 | B2 | 4/2011 | Oberberger | |
| 7,950,993 | B2 | 5/2011 | Oberberger | |
| 7,967,674 | B2 | 6/2011 | Baerlocher | |
| 8,360,873 | B1 * | 1/2013 | Wickett et al. | 463/29 |
| 2008/0108406 | A1 | 5/2008 | Oberberger | |
| 2008/0119283 | A1 | 5/2008 | Baerlocher | |
| 2013/0029760 | A1 * | 1/2013 | Wickett et al. | 463/29 |
| 2013/0029766 | A1 * | 1/2013 | Wickett et al. | 463/42 |

FOREIGN PATENT DOCUMENTS

| | | |
|---|---|---|
| WO | WO2006023907 | 3/2006 |
| WO | WO2006039348 | 4/2006 |

* cited by examiner

*Primary Examiner* — Pierre E Elisca
(74) *Attorney, Agent, or Firm* — DeLizio Gilliam, PLLC

(57) ABSTRACT

A wagering game system and its operations are described herein. In some embodiments, the operations can include determining, at a wagering game server, player account information associated with a plurality of players that are logged in at one or more predefined wagering game machines. The operations can also include determining a level of social interactivity to provide during game play to the plurality of players based, at least in part, on the player account information associated with the plurality of players. The operations can further include determining that a current level of social interactivity being provided during game play to the plurality of players is different than the level of social interactivity associated with the player account information, and dynamically changing a configuration of the one or more predefined wagering game machines to provide to the plurality of players the level of social interactivity associated with the player account information.

24 Claims, 8 Drawing Sheets

530

| CONFIGURATION SCHEDULE FOR LEVEL OF SOCIAL INTERACTIVITY IN CASINO FLOOR | | | | | | | |
|---|---|---|---|---|---|---|---|
| | MON | TUES | WED | THU | FRI | SAT | SUN |
| 4AM-12PM | 1 | 1 | 1 | 1 | 1 | 2 | 2 |
| 12PM-1PM | 1 | 1 | 1 | 2 | 2 | 2 | 2 |
| 1PM-5PM | 1 | 1 | 1 | 1 | 2 | 2 | 2 |
| 5PM - 10PM | 2 | 2 | 2 | 2 | 2 | 2 | 2 |
| 10PM - 4AM | 2 | 2 | 2 | 2 | 2 | 2 | 2 |

550

| CONFIGURATION SCHEDULE FOR LEVEL OF SOCIAL INTERACTIVITY IN CASINO FLOOR | | | | | | | |
|---|---|---|---|---|---|---|---|
| | MON | TUES | WED | THU | FRI | SAT | SUN |
| 4AM-12PM | 1 | 1 | 1 | 1 | 1 | 2 | 2 |
| 12PM-1PM | 1 | 1 | 1 | 2 | 2 | 2 | 2 |
| 1PM-5PM | 1 | 1 | 1 | 1 | 3 | 2 | 2 |
| 5PM - 10PM | 2 | 2 | 2 | 3 | 3 | 3 | 2 |
| 10PM - 4AM | 2 | 2 | 2 | 3 | 3 | 3 | 2 |

FIG. 5

ADJUSTABLE WAGERING GAME SYSTEM SOCIAL INTERACTIVITY CONFIGURATION

RELATED APPLICATIONS

This application claims the priority benefit of U.S. Provisional Application Ser. No. 61/374,015 filed Aug. 16, 2010.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2011, WMS Gaming, Inc.

FIELD

Embodiments of the inventive subject matter relate generally to wagering game systems, and more particularly to an adjustable wagering game system configuration for different levels of social interactivity.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Embodiments are illustrated in the Figures of the accompanying drawings in which:

FIG. 5 illustrates tables of example configuration schedules for changing the level of social interactivity configuration of wagering game machines in a wagering game system, according to some embodiments

DESCRIPTION OF THE EMBODIMENTS

This description of the embodiments is divided into five sections. The first section provides an introduction to some embodiments, while the second section describes example wagering game machine architectures. The third section describes example operations performed by some embodiments, the fourth section describes additional example embodiments, and the fifth section describes example wagering game machines in more detail. The sixth section presents some general comments.

INTRODUCTION

This section provides an introduction to some embodiments.

Wagering game systems offer wagering game players ("players") entertainment value and the opportunity to win monetary value. In various embodiments, wagering game systems can try to enhance the gaming experience by offering players different levels of social interactivity at the wagering game machines of the wagering game system. For example, the wagering game system can offer different levels of social interactivity at multi-player and multi-touch table gaming machines in a casino floor. In some embodiments, the wagering game system can adjust the level of social interactivity between players that is offered at the wagering game machines in the casino floor. For example, the wagering game system can determine a configuration schedule for the level of social interactivity that is offered at the wagering game machines of the casino floor based, at least in part, on historical player account information (e.g., player demographics and/or player gaming activity) gathered for different time periods during each day of week, as will be further described below with reference to FIGS. 1-3. In another example, the level of social interactivity that is offered to players at one or more wagering game machines in one or more sections of the casino floor can be dynamically adjusted based, at least in part, on the player account information (e.g., player demographics and/or player gaming activity) associated with the players that are currently logged into the wagering game system, as will be further described below with reference to FIGS. 1-2 and 4. Furthermore, in some examples, the wagering game system may allow players to suggest a change in the level of social interactivity that is offered at a wagering game machine, as will be further described below with reference to FIG. 6. A wagering game system that is configurable with different levels of social interactivity can customize various wagering game features for players, and therefore can provide a gaming experience that appeals to a majority of the players.

Figure 1:
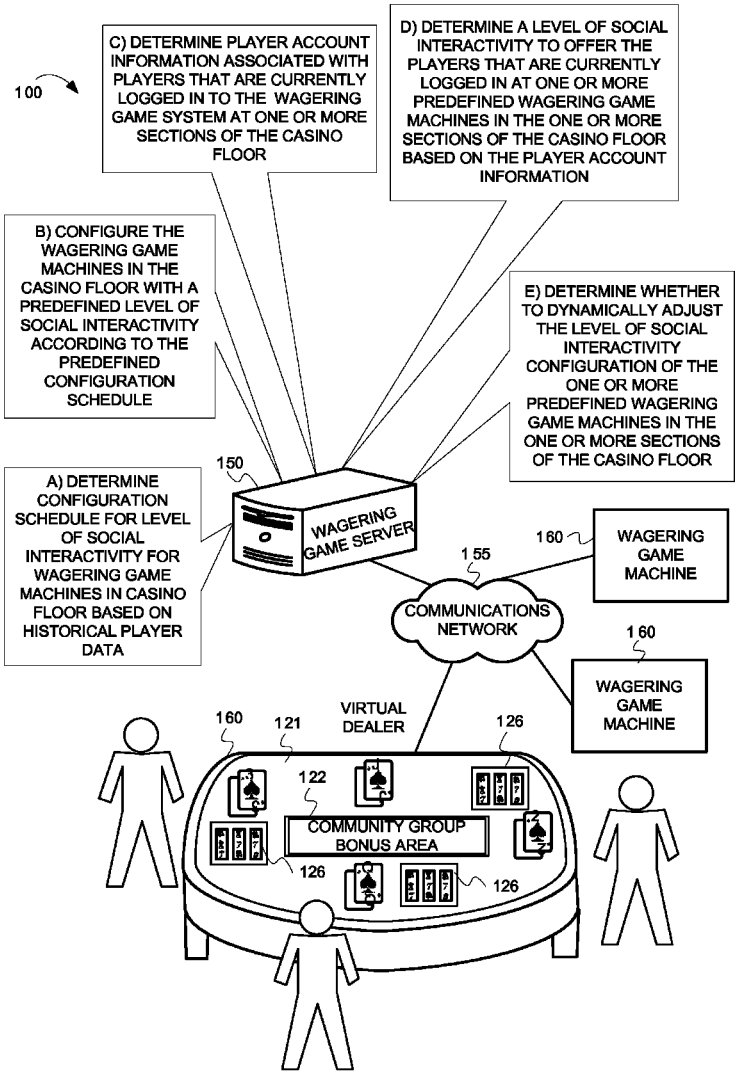
FIG. 1 is a conceptual diagram illustrating an example mechanism for changing the configuration of wagering game machines in the casino floor of a wagering game system to provide players different levels of social interactivity during game play, according to some embodiments.

FIG. 1 is a conceptual diagram illustrating an example mechanism for changing the configuration of wagering game machines in the casino floor of a wagering game system to provide players different levels of social interactivity during game play, according to some embodiments. In the example shown in FIG. 1, the wagering game system ("system") 100 includes a wagering game server 150 coupled to one or more wagering game machines 160 via a communications network 155 (e.g., a local area network (LAN), wireless LAN (WLAN), etc.). The wagering game system 100 can be implemented within a casino, and the wagering game machines 160 can be located in the casino floor. The wagering game machines 160 can include single player wagering game machines, wagering game machines with single player base game content and multi-player bonus game content (e.g., a bank of wagering game machines with a common overhead display for community bonus game content), and multi-player wagering game machines with both multi-player base and bonus game content (e.g., table wagering game machines). In addition to offering multi-player game content, some of the wagering game machines 160 can also offer multi-touch capabilities (e.g., an electronic table, or e-table, machine). For example, the e-table machine shown in FIG. 1 includes multi-player and multi-touch capabilities. The e-table machine includes a table wide multi-touch display 121 that presents both the multi-player base and bonus wagering game content. In one example, when the base wagering game is a card game, the multi-touch display 121 displays each player's hand in a predefined area of the display. In one example, for a community group bonus game, such as a community picking game that involves the players selecting certain items for bonus points, the display 121 can present the community picking game content on a community group bonus area 122 at the center of the e-table. In another example, for other types of bonus game (e.g., slots bonus games), a separate predefined area 126 of the display 121 can be used to present the bonus game content for each player. It is noted, however, that the e-table machines can have various other designs; for example, the e-table machine can include retractable screens (or other types of secondary displays) to display some of the base game and/or bonus game content.

The multi-player and multi-touch capabilities of wagering game machines, such as the e-table machine shown in FIG. 1, can allow casino operators to offer players various types of wagering games that offer two or more levels of social interactivity between players during game play. In the context of a gaming system, social interactivity can be defined to include social interactivity that takes place between players during game play in the same physical wagering game machine, and social interactivity that takes place between players during game play in proximal wagering game machines or related wagering game machines. In one example, a social interactivity feature or opportunity that can be offered to players at the same physical wagering game machine that is configured with a first level of social interactivity is a community group bonus game. The players that participate in the community group bonus game all share in the results of the bonus game. In some cases, the activity of one of the players may trigger the community group bonus game for all the players in the table. In one example, an enhanced social interactivity feature or opportunity between players at the same physical wagering game machine that is configured to offer a second or enhanced level of social interactivity may involve players picking cards or bonus game elements from a common display area of the wagering game machine (at the same time or in a certain order) during game play. Another example of an enhanced social interactivity feature may involve players swapping cards or bonus game elements during game play. In yet another example, an enhanced social interactivity feature or opportunity between players in proximal or related wagering game machine may involve sharing a percentage of a relatively large win at a wagering game machine with a plurality of wagering game machines that are adjacent to the wagering game machine. Another example of an enhanced social interactivity feature or opportunity may involve temporarily combining the displays of a plurality of adjacent wagering game machines to play a single community group bonus game across all the adjacent wagering game machines. The different levels of social interactivity can increase/decrease the number of social interactivity features or opportunities that are offered to players during game play, or otherwise increase/decrease the relative amount of the social interaction between players during game play. Additional examples of social interactivity features or opportunities will be described further below.

In some implementations, at stage A (shown in FIG. 1), the wagering game server 150 determines a configuration schedule for the level of social interactivity for wagering game machines 160 in the casino floor based on historical player data. The wagering game server 150 can determine a configuration schedule for adjusting the level of social interactivity offered to players in the casino floor at various time periods during each day of the week. For example, the wagering game server 150 may configure the wagering game machines 160 in the casino floor to have a default or first level of social interactivity during the morning and afternoon on weekdays, and an enhanced or second level of social interactivity during the evening and night on weekdays and on the weekends. In other examples, the wagering game server 150 may configure the casino floor based on three or more levels of social interactivity. In one embodiment, to determine the configuration schedule, the wagering game server 150 can determine historical player account information of players that played wagering game in the casino floor (e.g., players that logged in to the wagering game system 100). For example, the wagering game server 150 can access the player accounts (e.g., player profiles) maintained on the wagering game system 100 to gather historical player account information from a predefined period of time, such as the past 3 months, 6 months, 1 year, or 2 years. The wagering game server 150 can gather historical player account information, such as player demographics, player preferences, and/or player account activity. The player demographic information can indicate each player's age, gender, ethnicity, etc. The player preference information can indicate each player's base wagering game preferences, bonus wagering game preferences, table game preferences, social interactivity preferences, etc. The player account activity information can indicate each player's past gaming activity in the wagering game system, such as the amount of coin-in for each type of wagering game, and the number of times the player played each type of wagering game. In one example, after gathering the historical player account information, the wagering game server 150 can sort the information according to the time and day that the players played the wagering games on the casino floor. The wagering game server 150 can then analyze the information to determine historical player statistics for different time periods during each day of the week. The wagering game server 150 can use the historical player statistics to determine a level of social interactivity in wagering games that will likely appeal to the players, and therefore, to determine and define a configuration schedule for the level of social interactivity in the casino floor for different time periods during each day of the week, as will be further described below with reference to FIG. 3.

At stage, B, the wagering game server 150 configures the wagering game machines 160 in the casino floor with a predefined level of social interactivity according to the predefined configuration schedule. For example, the wagering game server 150 monitors the current time and day of the week, and determines whether the level of social interactivity should be changed based on the predefined configuration schedule. When the wagering games server 150 determines that the level of social interactivity should be adjusted based the current time and day of the week, the wagering game server 150 configures the wagering game machines 160 in the casino floor with the predefined level of social interactivity that is associated with the current time and day of the week. For example, the wagering game server 150 can change the configuration of the wagering game machines 160 from a first level of social interactivity to a second level of social interactivity. In one embodiment, the wagering game server 150 can broadcast a configuration message to the wagering game machines 160 to cause the machines to adjust the level of social interactivity. In response to receiving the configuration message, the wagering game machines 160 adjust the level of social interactivity that is offered to players by loading a different set of configuration files and/or changing a variable in the game code associated with the wagering games to enable or disable certain social interactivity features. In some cases, in addition to the configuration message indicating the change in the level of social interactivity, the wagering game server 150 can send configuration files, game assets and other game content if the wagering games need to be updated to allow the change in the level of social interactivity. In some embodiments, in response to receiving the configuration message, the wagering game machines 160 load a different version of the wagering games (i.e., different game code) that provide a different level of social interactivity during game play. In one example, the wagering game server 150 causes all the wagering game machines 160 in the casino floor that have the hardware and software capabilities to offer two or more levels of social interactivity to adjust the configuration for the level of social interactivity based on the predefined configuration schedule. For example, multi-player table gaming machines that have one or more multi-touch screens and offer multi-player wagering games can be configurable with two or more levels of social interactivity.

At stage C, the wagering game server 150 determines player account information associated with players that are currently logged into the wagering game system 100 at one or more wagering game machines 160 in one or more sections of the casino floor. For example, based on player card identification information or other type of login information, the wagering game server 150 can access the player accounts of the players that are currently logged into the wagering game system 100 at the one or more sections of the casino. As described above, from the player accounts, the wagering game server 150 can determine player account information, such as player demographics, player preferences, and/or player gaming activity. In one example, the one or more wagering game machines 160 in the one or more sections of the casino floor can be a plurality of wagering game machines 160 in a first section of the casino floor that the casino operator wants to continuously monitor to determine whether to adjust the level of social interactivity. For example, the first section of the casino floor may be a section of the casino floor that includes wagering game machines 160 with relatively high minimum wager requirements (e.g., the "high roller" section of the casino floor), or a section of the casino floor with a relatively high concentration of multi-player wagering game machines 160. In another example, the one or more wagering game machines 160 can be a group of e-table machines (with multi-player and multi-touch capabilities) at a first section of the casino floor, and another group of e-table machines at a second section of the casino floor, and/or two or more banks of related wagering game machines 160 (with multi-player bonus games) in two or more sections of the casino floor. In some embodiments, even though the predefined configuration schedule for level of social interactivity can be implemented to configure the casino floor (as described above in stages A and B), the wagering game server 150 can continuously monitor the player account information of players that are currently logged in at one or more predefined wagering game machines in one or more sections of the casino floor to determine whether to dynamically adjust the level of social interactivity. In other words, to offer an additional level of customization and dynamic adjustability at certain predefined wagering game machines 160, the wagering game server 150 can change the level of social interactivity (e.g., specified by the predefined configuration schedule) if the player account information associated with the players that are currently logged in at the predefined wagering game machines 160 indicate that the level of social interactivity should be changed. In some embodiments, the wagering game server 150 can be configured to identify and continuously monitor the predefined wagering game machines 160 in one or more sections of the casino floor, and adjust the configuration of the predefined wagering game machines 160, based on the network addresses and/or the wagering game machine IDs (or other identification information) associated with the predefined wagering game machines 160.

At stage D, the wagering game server 150 determines a level of social interactivity to offer the players that are currently logged in at the one or more predefined wagering game machines 160 in the one or more sections of the casino floor based on the player account information. In one embodiment, the wagering game server 150 analyzes the player account information to determine player statistics for the players that are currently logged in at the one or more predefined wagering game machines 160. The wagering game server 150 can use the player statistics to determine whether to adjust the level of social interactivity that is being offered by the one or more predefined wagering game machines 160 at the one or more sections of the casino floor, as will be further described below with reference to FIG. 4. For example, based on the average age of the players that are currently logged in at a predefined plurality of related e-table machines in two sections of the casino floor, the wagering game server 150 may determine that the e-table machines should be configured to offer the players a second or enhanced level of social interactivity.

At stage E, the wagering game server 150 determines whether to dynamically adjust the level of social interactivity configuration at the predefined one or more wagering game machines 160 in the one or more sections of the casino floor. For example, the wagering game server 150 may determine that the one or more predefined wagering game machines 160 should offer a second or enhanced level of social interactivity based on the player statistics determined from the account information associated with the players that currently logged in. However, the one or more predefined wagering game machines 160 are currently offering a first level of social interactivity (e.g., based on the predefined configuration schedule). In this example, the wagering game server 150 dynamically adjusts the level of social interactivity configuration of the one or more predefined wagering game machines 160 to the second level of social interactivity, as will be further described below with reference to FIG. 4.

It is noted, however, that in other embodiments the level of social interactivity offered in the casino floor can be configured by other techniques. For example, instead of configuring the casino floor based on a predefined configuration schedule, and then dynamically adjusting the configuration for one or more predefined wagering game machines based on the players that are currently logged in, the wagering game server 150 may continuously monitor and dynamically adjust the level of social interactivity configuration of the wagering game machines 160, on a section by section basis, for all sections of the casino floor based on the players that are currently logged in. In some embodiments, the wagering game server 150 can be configured to use different criteria to determine whether to adjust the level of social interactivity configuration in some sections of the casino floor compared to other sections of the casino floor (or between groups of wagering game machines). In some embodiments, the wagering game server 150 can allow players that are currently logged in at certain wagering game machines 160 to suggest changes the level of social interactivity the wagering game machines 160 are currently offering, as will be further described below with reference to FIG. 6.

In some embodiments, in addition to accessing player account information, the wagering game server 150 may also use other techniques to determine player demographic information. For example, the wagering game server 150 can access player demographic information obtained from an audience measurement system. The audience measurement system may include a network of webcams or other types of video cameras positioned throughout the casino floor (e.g., eye-in-the-sky cameras, cameras on digital signage, etc.). The audience measurement system can detect a person's approximate age, gender, and other demographic information via one or more of the video cameras. The audience measurement system may also detect a person's amount of interest (e.g., based on facial expressions or celebrations) in a particular wagering game, the number of bystanders standing around a particular wagering game machine, and/or the number of people in a particular section of the casino floor. In another example, the wagering game server 150 can determine information about some players via customer relationship management (CRM) data. For example, the wagering game system 100 may be linked to a hotel/resort system that maintains hotel guess accounts. The wagering game system 150 can monitor the hotel guess accounts to determine information (e.g., demographic information) about people that check in to the hotel, since they are likely to play wagering games at the hotel casino. The wagering game server 150 can also identify people that check in to the hotel that have player accounts maintained by the wagering game system 100.

Although FIG. 1 describes some embodiments, the following sections describe many other features and embodiments.

Operating Environment

This section describes example operating environments and networks and presents structural aspects of some embodiments. More specifically, this section includes discussion about wagering game system architectures.

Wagering Game System Architectures

Figure 2:
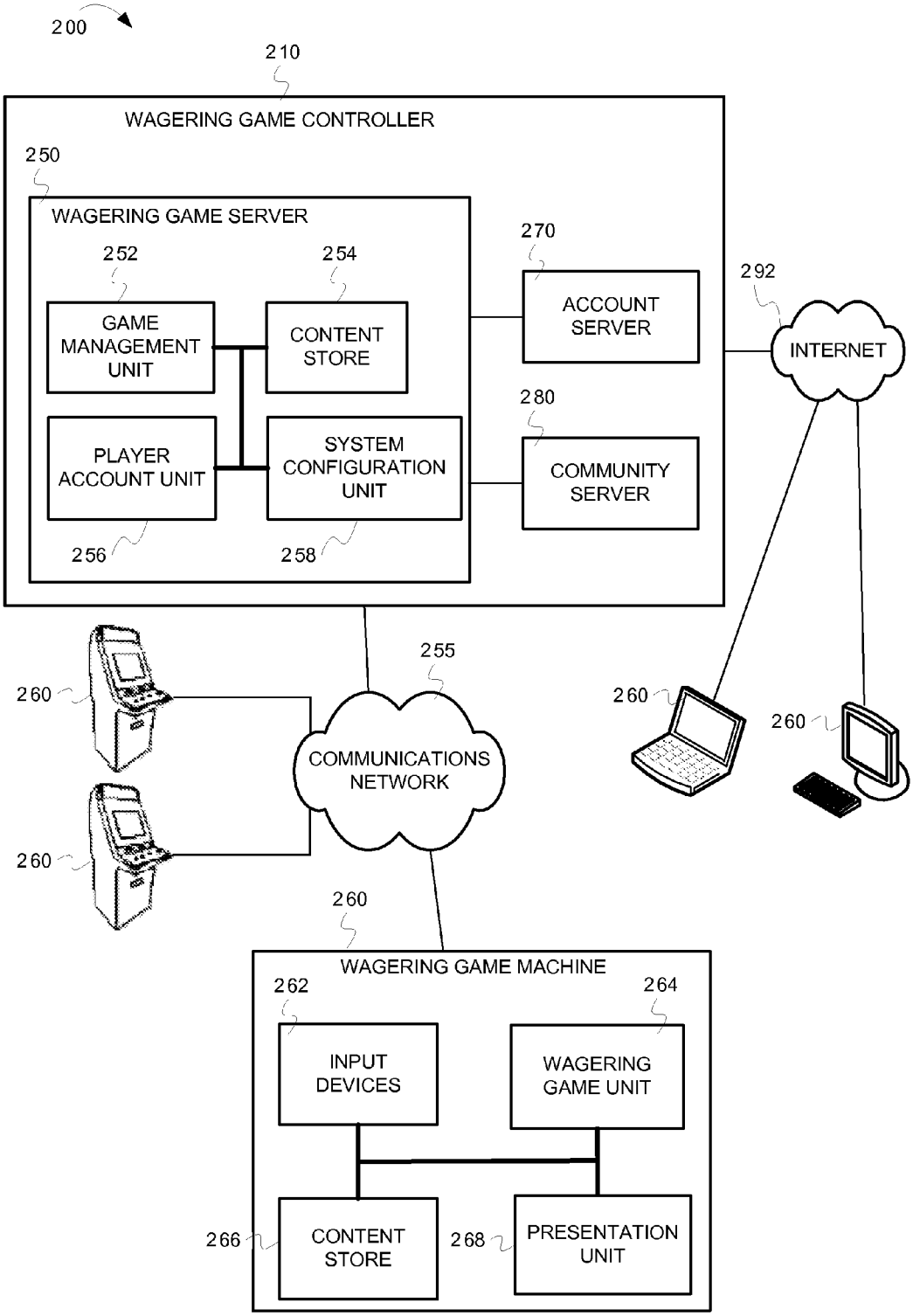
FIG. 2 is a conceptual diagram that illustrates an example of a wagering game system architecture, according to some embodiments.

FIG. 2 is a conceptual diagram that illustrates an example of a wagering game system architecture 200, according to some embodiments. As illustrated, the wagering game system architecture 200 includes a wagering game controller 210 and a plurality of wagering game machines 260. The wagering game controller 210 is configured to control game content (e.g., game assets, game updates, game results, etc.) and communicate game-related information and other information (e.g., virtual gaming community services, casino floor configuration messages) to and from the plurality of wagering game machines 260. In one example, the wagering game controller 210 includes a wagering game server 250, an account server 270, and a community server 280. It is noted that the wagering game controller 210 may also be configured to communicate with other systems, devices, and networks.

The wagering game server 250 is configured to manage and control content for presentation on the wagering game machines 260. The wagering game server 250 is also configured to manage the configuration of the wagering game machines 260 to adjust the level of social interactivity. In some embodiments, the wagering game server 250 includes a game management unit 252 configured to manage game content and provide game content and other game-related information associated with primary (or base) wagering games and secondary wagering games (e.g., bonus games) to the wagering game machines 260. The game management unit 252 is configured to generate (e.g., using a random numbers generator) game results (e.g., win/loss values), including win amounts, for wagering games played on the wagering game machines 260. The game management unit 252 can communicate the game results to the wagering game machines 260 via the network 255. In some embodiments, the game management unit 252 can also generate random numbers and provide them to the wagering game machines 260 so that the wagering game machines 260 can generate game results. The wagering game server 250 can also include a content store 254 configured to store content used for presenting wagering games (e.g., base games, secondary bonus games, etc.), and other game-related information associated with wagering games presented on the wagering game machines 260 of the system 200. The wagering game server 250 can also include a player account unit 256 configured to identify and access player accounts based on player card identification information, log-in information (e.g., username and password), or other types of identification information provided by players when logging into the wagering game system 200. For example, when a player inserts a player card into a card reader of a wagering game machine 260, the player account unit 256 can determine the player card identification information and identify the player account that is associated with the player card identification information to initiate a wagering game session of the player. The player account unit 256 can also obtain player account information to determine player statistics used for configuring the casino floor with different levels of social interactivity, as will be further described herein with reference to FIGS. 1-5. For example, the player account unit 256 can obtain player account information (e.g., player demographic information, player preference information, player gaming activity information, etc.) from the account server 270 and from the community server 280. Furthermore, the wagering game server 250 can also include a system configuration unit 258 that determines a level of social interactivity for the casino floor based on the player statistics determined by the player account unit 256. The system configuration unit 258 dynamically configures the wagering game machine 260 in one or more sections of the casino floor with the level of social interactivity determined based on the player statistics, as will be further described herein with reference to FIGS. 1-5.

The account server 270 is configured to control player-related accounts accessible via the wagering game system 200. The account server 270 can manage player financial accounts (e.g., performing funds transfers, deposits, withdrawals, etc.) and player information (e.g., account identification numbers, player preferences, player demographics, avatars, screen name, social contacts, financial information, player account activity, and/or player achievements). The account server 270 can also provide auditing capabilities, according to regulatory rules, and track the performance of players, machines, and servers. The account server 270 can include an account controller configured to control information for player wagering game system accounts. The account server 270 can also include an account store configured to store information for player wagering game system accounts.

The community server 280 is configured to provide a wide range of services to members of virtual gaming communities. For example, the community server 280 may allow players to:

Create Social Networks—When creating social networks, members can create electronic associations that inform network members when selected members are: 1) online, 2) performing activities, 3) reaching milestones, 4) etc.

Establish a Reputation—Community members can establish reputations based on feedback from other community members, based on accomplishments in the community, based on who is in their social network, etc.

Provide Content—Community members can provide content by uploading media, designing wagering games, maintaining blogs, etc.

Filter Content—Community members can filter content by rating content, commenting on content, or otherwise distinguishing content.

Interact with Other Members—Community members can interact via newsgroups, chat, e-mail, discussion boards, instant messaging, etc.

Participate in Community Activities—Community members can participate in community activities, such as multiplayer games, bonus games, interactive meetings, discussion groups, real-life meetings, etc.

Connect Casino Players to Online Members—Community members who are playing in casinos can interact with members who are online. For example, online members may be able to: see activities of social contacts in the casino, chat with casino players, participate in community games involving casino players, etc.

In some embodiments, the community server 280 enables online community members (e.g., operating a personal computer (PC) or a mobile device) to participate in and/or monitor wagering games that are being presented in one or more casinos. The community server 280 can enable community members to connect with and track each other. For example, the community server 280 can enable community members to select other members to be part of a social network. The community server 280 can also enable members of a social network to track what other social network members are doing in a virtual gaming community and a real-world casino. For example, in some implementations, the community server 280 assists in enabling members of a social network to see when network members are playing wagering game tables and machines in a casino, accessing a virtual gaming community web site, achieving milestones (e.g., winning large wagers in a casino), etc.

The community server 280 can store and manage content for a virtual gaming community. For example, in some embodiments, the community server 280 can host a web site for a virtual gaming community. In one example, the virtual gaming community website may include, or provide access to, one or more online casinos. Additionally, the community server 280 can enable community members and administrators to add, delete, and/or modify content for virtual gaming communities. For example, the community server 280 can enable community members to post media files, member-designed games, commentaries, etc., all for consumption by members of a virtual gaming community.

The community server 280 can track behavior and gaming activity of community members. In some embodiments, the community server 280 tracks how individuals and/or groups use the services and content available in a virtual gaming community. The community server 280 can then report the gaming activity of each player to the wagering game server 250. The community server 280 can analyze member behavior and categorize community members based on their behavior. The community server 280 can configure network components to customize content based on individual and/or group habits.

The community server 280 can manage various promotions offered to members of a virtual gaming community. For example, the promotions community server 280 can distribute promotional material when members achieve certain accomplishments (e.g., scores for online games) in a virtual gaming community. Members may use some of the promotional material when playing wagering games in a casino.

The wagering game machines 260 are configured to present wagering games and receive and transmit information (e.g., to/from the wagering game server 250) to control the content that is presented for the wagering games (e.g., base wagering games and secondary wagering games). The wagering game machines 260 can include input devices 262, a wagering game unit 264, a content store 266, and a presentation unit 268. The input devices 262 may include buttons, joysticks, touch screens, cameras, etc., used to detect player input associated with wagering games. The wagering game unit 264 is configured to manage and control the game content that is presented on the wagering game machine 260. In some embodiments, the wagering game unit 264 can detect configuration messages received from the wagering game server 250 which cause the wagering game unit 264 to change the level of social interactivity configuration in the wagering game machine 260. Furthermore, the wagering game unit 264 can generate game results based on random numbers received from the wagering game server 250, or may communicate with the wagering game server 250 to obtain the game results. The content store 266 is configured to store content that is presented on the wagering game machine 260. The presentation unit 268 is configured to control the presentation of the game content on the wagering game machine 260. The presentation unit 268 can include one or more browsers and any other software and/or hardware suitable for presenting audio and video content. It is noted, however, that in other implementations the game content can be presented using other display technologies.

The wagering game machines 260 described herein can take any suitable form, such as floor standing models, handheld mobile units, bar-top models, workstation-type console models, surface computing machines, etc., and can access a communication network 255 to communication with the wagering game controller 210 via a wireless or wired connection. Further, wagering game machines 260 can be primarily dedicated for use in conducting wagering games, or can include non-dedicated devices, such as personal computers (PC), mobile phones, personal digital assistants (PDAs), laptop computers, etc. For example, the non-dedicated devices can provide players access to wagering games via a wireless network within a physical casino, or remotely via the Internet 292.

In some embodiments, each of the wagering game machines 260 and the wagering game server 250 are configured to work together such that the wagering game machine 260 can be operated as a thin, thick, or intermediate client. For example, one or more elements of game play may be controlled by the wagering game machine 260 (client) or the wagering game server 250 (server). Game play elements can include executable game code, lookup tables, configuration files, game results, audio or visual representations of the game, game assets or the like. In a thin-client example, the wagering game server 250 can perform functions such as determining game results or managing assets, while the wagering game machine 260 can present an audible/graphical representation of such outcome or asset modification to the players. In a thick-client example, the wagering game machine 260 can determine game outcomes and communicate the outcomes to the wagering game server 250 for recording or managing a player's wagering game system account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Each component shown in the wagering game system architecture 200 is shown as a separate and distinct element connected via the communications network 255. However, some functions performed by one component could be performed by other components. For example, the wagering game server 250 can be configured to perform some or all of the functions of the account server 270, and/or the game management unit 252 can be configured to perform some or all of the functions of the player account unit 256 and/or the system configuration unit 258. Furthermore, the components shown may all be contained in one device, but some, or all, may be included in, or performed by multiple devices, as in the configurations shown in FIG. 2 or other configurations not shown, e.g., the system configuration unit 258 can be distributed across the wagering game server 250 and the wagering game machines 260. Furthermore, the wagering game system architecture 200 can be implemented as software, hardware, any combination thereof, or other forms of embodiments not listed. For example, any of the network components (e.g., the wagering game tables, machines, servers, etc.) can include hardware and machine-readable media including instructions for performing the operations described herein. Machine-readable media includes any mechanism that provides (i.e., stores and/or transmits) information in a form readable by a machine (e.g., a wagering game table, machine, computer, etc.). For example, tangible machine-readable storage media includes read only memory (ROM), random access memory (RAM), magnetic disk storage media, optical storage media, flash memory machines, and other types of tangible medium suitable for storing instructions. Machine-readable transmission media includes any media suitable for transmitting software over a network.

Although FIG. 2 describes some embodiments, the following sections describe many other features and embodiments.

Example Operations

This section describes operations associated with some embodiments. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

The following discussion of FIGS. 3-6 describes example mechanisms for adjusting the level of social interactivity configuration of one or more wagering game machines 260 of a wagering game system.

Figure 3:
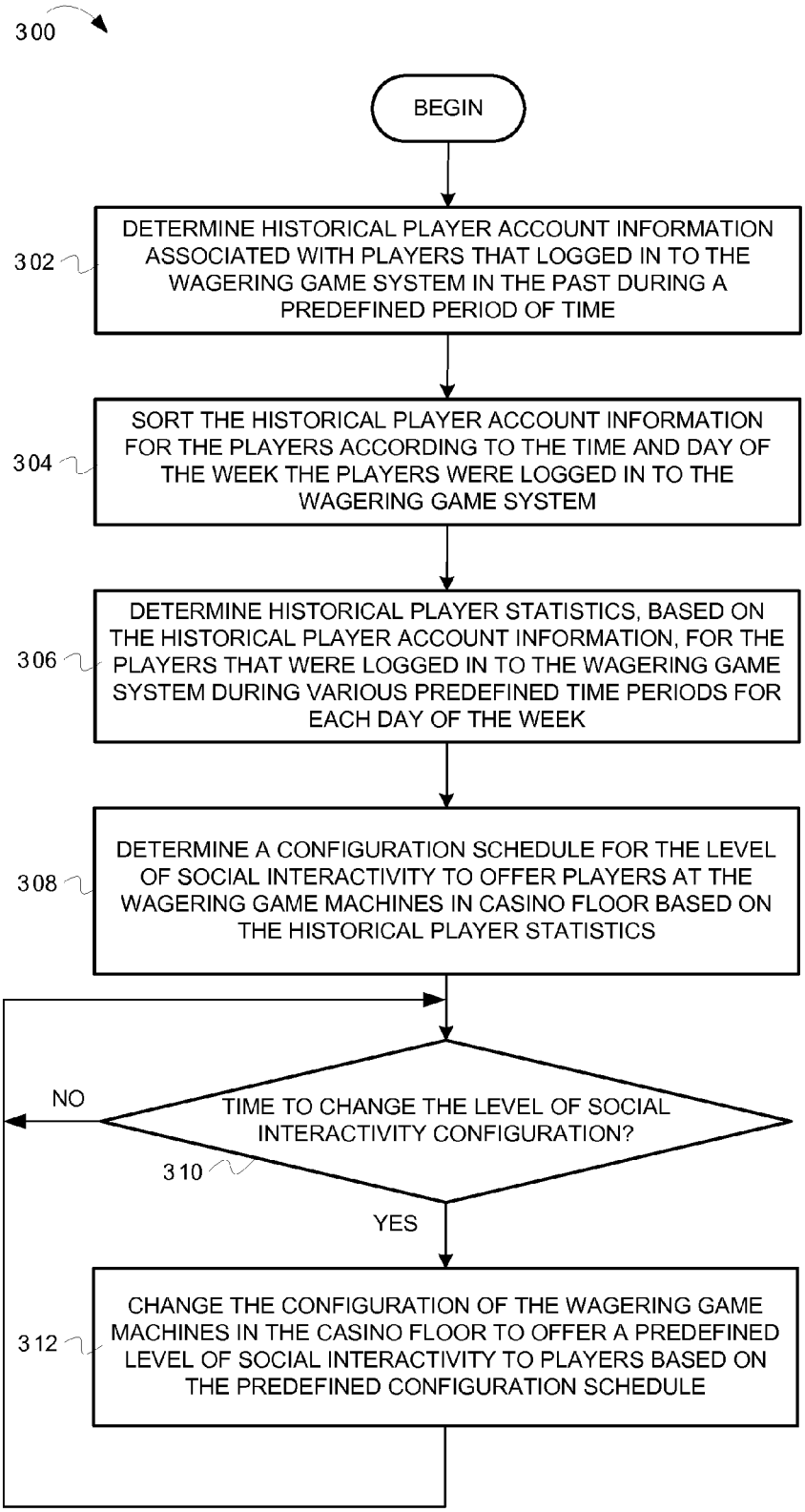
FIG. 3 is a flow diagram illustrating operations for changing the configuration of wagering game machines in a wagering game system to adjust the level of social interactivity that is offered to players, according to some embodiments.

FIG. 3 is a flow diagram ("flow") 300 illustrating operations for changing the configuration of wagering game machines in a wagering game system to adjust the level of social interactivity that is offered to players, according to some embodiments. The flow of 300 will be described with reference to the example system architecture of FIG. 2. The flow diagram begins at block 302.

At block 302, the wagering game server 250 determines historical player account information of players that logged in to the wagering game system 200 in the past during a predefined period of time. For example, the player account unit 256 can access the player accounts (e.g., maintained on the account server 270) for the players that logged in to the wagering game system 200 during a predefined period of time (such as the past 3 months, 6 months, 1 year, or 2 years), and determine historical player account information for these players. In one example, the wagering game system 200 can keep a timestamp record (e.g., in the player accounts maintained in the account server 270) of the time and day each player logs in to, and logs off, the wagering game system 200 via one or more wagering game machines 260 in the casino floor. The player account unit 256 can gather historical player account information from the player accounts, such as player demographics, player preferences, and/or player account activity. The player demographic information can indicate each player's age, gender, ethnicity, etc. The player preference information can indicate each player's base wagering game preferences, bonus wagering game preferences, table game preferences, social interactivity preferences, etc. The player account activity information can indicate each player's past gaming activity in the wagering game system, such as the amount of coin-in for each type of wagering game, and the number of times the player played each type of wagering game. After block 302, the flow continues at block 304.

At block 304, the wagering game server 250 sorts the historical player account information for the players according to the time and day of the week the players were logged in to the wagering game system 200 via one or more wagering game machines 260 in the casino floor. In one implementation, the player account unit 256 determines the players that were logged in to the wagering game system 200 each hour during each day of the week during the predefined period of time, and groups the historical player account information associated with the players according to the time (e.g., hourly) and day that they were logged in. For example, the player account unit 256 can group the historical player account information associated with players that were logged in to the wagering game system 200 each hour (e.g., between 8:00 am-8:59 am, 9:00 am-9:59 am, etc.) during each day of the week during the past year. It is noted, however, that in other implementations the player account unit 256 can sort the historical player account information differently, such as in sequential time order for each day of the week, or in two hour increments for each day of the week (rather than hourly). After block 304, the flow continues at block 306.

At block 306, the wagering game server 250 determines historical player statistics, based on the historical player account information, for the players that were logged in to the wagering game system 200 during various predefined time periods for each day of the week. In one implementation, the player account unit 256 determines historical player statistics based on the historical player account information associated with each predefined time period (e.g., hourly) for each day of the week. For example, the player account unit 256 determines a different set of hourly historical player statistics based on the historical player account information associated with players that were logged in to the wagering game system 200 for each hour during each day of the week. For example, the player account unit 256 determines a first set of hourly historical player statistics associated with the players that were logged in to the wagering game system 200 between 8:00 am and 8:59 am, a second set of hourly historical player statistics associated with the players that were logged in to the wagering game system 200 between 9:00 am and 9:59 am, etc. It is noted, however, that in other implementations the player account unit 256 can determine historical player statistics for other predefined time periods, such as 2-hour time periods, 3-hour time periods, etc. during each day of the week.

The player account unit 256 can determine various types of historical player statistics depending on the type of historical player account information that is available for analysis. The player account unit 256 can use the historical player statistics to determine a level of social interactivity in wagering games that will likely appeal to the types of players that historically play in the casino during the different predefined time periods each day of the week, and therefore, to determine and define a configuration schedule for the level of social interactivity in the casino floor, as will be further described below. In one example, if the player account unit 256 determines that the type of historical player account information that is available for analysis includes only the age of the players (e.g., determined based on each player's birth date), the player account unit 256 can determine the average player age of the players that were logged in to the wagering game system 200 during each of the predefined time periods (e.g., hourly) of each day of the week. The average age of the players can serve to indicate the level of social interactivity that is likely to appeal to the players. In another example, if both the age of the players and the player gaming activity is available for analysis, the player account unit 256 can determine the average player age of the players that were logged in, and also the types of wagering games that the players played (based on the player activity data). The types of wagering games that the players played can also indicate the level of social interactivity that is likely to appeal to the players. The player account unit 256 can rate each type of wagering game played by the players using a player activity point score from 1-10, which indicates a range of the level of social interactivity associated with each type of wagering game (e.g., a point score of 1 indicates the least social interactivity and a point score of 10 indicates the most social interactivity). For example, a point score of between 1-3 points could be assigned to slots wagering games or similar types of games that have little or no social interaction, a point score of between 4-7 points could be assigned to wagering games offered in banks of wagering game machines that involve community group bonus games with some level of social interaction, and a point score of 8-10 points could be assigned to wagering games offered on table gaming machines that involve a relatively high level of social interaction. The player account unit 256 can determine an average player activity point score for each predefined period of time during each day of the week. In this example, similar to the player gaming activity information, the player account unit 256 can rate the average age of the players according to an average age point score. For example, an average age between ages 21-40 yrs of age could translate to an average age point score between 8-10 points, an average age between ages 41-60 yrs of age could translate to an average age point score between 4-7 points, and an average age over 61 yrs of age could translate to an average age point score between 1-3 points. The player account unit 256 can then apply weights to the data to determine a social interactivity point score from 1-10 points that indicates the level of social interactivity that is likely to appeal to the players. For example, the player account unit 256 can apply a weight of 0.3 (or 30% contribution amount) to the average age point score of the players during each predefined time period, and a weight of 0.7 (i.e., a 70% contribution amount) to the average player activity point score to determine the social interactivity point score. In this example, if the average age point score is 6.2, and the player activity point score is 9.0, the social interactivity point score is 8.16. The player account unit 256 can use the social interactivity point score (e.g., derived from the average age and player activity information) to determine the level of social interactivity that is likely to appeal to the players for each predefined time period during each day of the week, as will be further described below. In other examples, the player account unit 256 can determine the historical player statistics based on other player account information, or other combinations of player account information, using a similar weighting method as was described above. For example, the player account unit 256 can determine the historical player statistics based only on the player gaming activity information, based only on player preference information, or based on a combination of player age, player gaming activity information, and player preference information. After block 306, the flow continues at block 308.

At block 308, the wagering game server 250 determines a configuration schedule for the level of social interactivity the wagering game machines 260 in the casino floor will offer players based on the historical player statistics. In one implementation, when a single type of player account information is analyzed to determine historical player statistics, the system configuration unit 258 of the wagering game server 250 associates a certain level of social interactivity with each of a plurality of ranges of the data. For instance, in the example described above which determines the ages of the players to determine an average age, the system configuration unit 258 can associate a first level of social interactivity with an average age of 61 years of age and above, a second level of social interactivity with an average age of between 41 and 60 years of age, and a third level of social interactivity with an average age of between 21 and 40 years of age. In this example, if the player account unit 256 determines that the average age of the players is 45 years old, the system configuration unit 258 would associate the players in that particular time period with a second level of social interactivity. If the wagering game system 200 supports two levels of social interactivity, the system configuration unit 258 can associate a first level of social interactivity with an average age of 46 years of age and above, and a second level of social interactivity with an average age of between 21 and 45 years of age. In another example, when two or more types or categories of player account information are analyzed to determine the historical player statistics, the system configuration unit 258 associates a certain level of social interactivity with each of a plurality of ranges of the social interactivity point score. For instance, in the example described above where the player account unit 256 uses a weighting scheme to determine the social interactivity point score (based on the average age point score and the player activity point score), the system configuration unit 258 can associate a first level of social interactivity with a social interactivity point score between 1-3 points, a second level of social interactivity with a social interactivity point score between 4-7 points, and a third level of social interactivity with a social interactivity point score between 8-10 points. In this example, if the player account unit 256 calculates a social interactivity point score of 8.16, the system configuration unit 258 would associate the players in that particular time period with a third level of social interactivity. As described above, this can be adjustable based on the number of levels of social interactivity that are supported by the wagering game system 200. For example, if only two levels of social interactivity are supported, the system configuration unit 258 can associate a first level of social interactivity with a social interactivity point score between 1-5 points, and a second level of social interactivity with a social interactivity point score between 6-10 points.

After determining the level of social interactivity associated with the players for each of the predefined time periods during each day of the week, the system configuration unit 258 can determine a configuration schedule for adjusting the level of social interactivity offered to players in the casino floor. For example, if the wagering game system 200 supports two levels of social interactivity, the system configuration unit 258 can determine and define a configuration schedule similar to the one shown in table 530 of FIG. 5. In this example, the historical player statistics indicate that a greater percentage of players that prefer a second or enhanced level of social interactivity visit the casino during the evenings and nights on the weekdays and during the weekends. Also, players that prefer the second or enhanced level of social interactivity start playing earlier in the afternoon on Fridays, and also during lunch on Thursdays. A greater percentage of players that prefer a default or first level of social interactivity visit the casino during the rest of the time periods (e.g., generally M-TH mornings and afternoons, and Friday mornings). It is noted, however, that in other examples, the system configuration unit 258 can determine a configuration schedule based on three or more levels of social interactivity. For example, in the configuration schedule shown in table 550 of FIG. 5, some of the time periods that were associated with a second level of social interactivity in the configuration schedule of table 530 are now associated with a third level of social interactivity. In table 550, since the wagering game system 200 supports three levels of social interactivity, the system configuration unit 258 can associate the player statistics with three levels of social interactivity, and accordingly set the configuration schedule, to further customize the gaming experience for the players. After block 308, the flow continues at block 310.

At block 310, the wagering game server 250 determines whether to change the level of social interactivity configuration of the wagering game machines 260 in the casino floor according the predefined configuration schedule. If the system configuration unit 258 determines that it is not time to change the level of social interactivity configuration, the flow loops back to the beginning of block 310 to continue to perform the configuration check. The system configuration unit 258 can be programmed to perform the configuration check according to the predefined configuration schedule periodically (e.g., every 15 minutes, every 30 minutes, or every hour). In one example, if the system configuration unit 258 determines that it is 12 pm on Wednesday, according to the configuration schedule shown in FIG. 5, the system configuration unit 258 will not change the level of social interactivity configuration of the wagering game machines 260 in the casino floor. If the system configuration unit 258 determines that it is time to change the level of social interactivity configuration, the flow continues at block 312. For example, if the system configuration unit 258 determines that it is 12 pm on Friday, the system configuration unit 258 will change the level of social interactivity configuration of the wagering game machines 260 from a first level to a second level.

At block 312, the wagering game server 250 changes the configuration of the wagering game machines 260 in the casino floor to offer a predefined level of social interactivity to the players based on the predefined configuration schedule. In one embodiment, the system configuration unit 258 broadcasts a configuration message to the wagering game machines 260 in the casino floor to adjust the level of social interactivity. The configuration message may include an indication of the predefined level of social interactivity. In response to receiving the configuration message, the wagering game machines 260 adjust the level of social interactivity that is offered to players by loading a different set of configuration files and/or changing a variable in the game code associated with the wagering games to enable or disable certain social interactivity features associated with the predefined level of social interactivity. In another embodiment, in addition to the configuration message indicating the change in the level of social interactivity, the system configuration unit 258 can send configuration files, game assets, and/or other game content if the wagering games need to be updated to allow the change in the level of social interactivity. In some embodiments, in response to receiving the configuration message, the wagering game machines 260 load a different version of the wagering games (i.e., different game code) that provide a different level of social interactivity during game play. In one example, the system configuration unit 258 causes all the wagering game machines 260 in the casino floor that have the hardware and software capabilities to offer two or more levels of social interactivity to adjust the configuration for the level of social interactivity. For example, multi-player table gaming machines that have one or more multi-touch screens and offer multi-player wagering games can be configurable with two or more levels of social interactivity. After adjusting the configuration, the flow loops back to the beginning of block 310 to continue to perform the configuration check periodically (e.g., every 15 minutes, every 30 minutes, or every hour). Furthermore, in some embodiments, at the same time that the wagering game server 250 implements the configuration schedule (as described herein), the wagering game server 250 may dynamically adjust the configuration based on the players that are currently logged in, as will be further described below with reference to FIG. 4.

Figure 4:
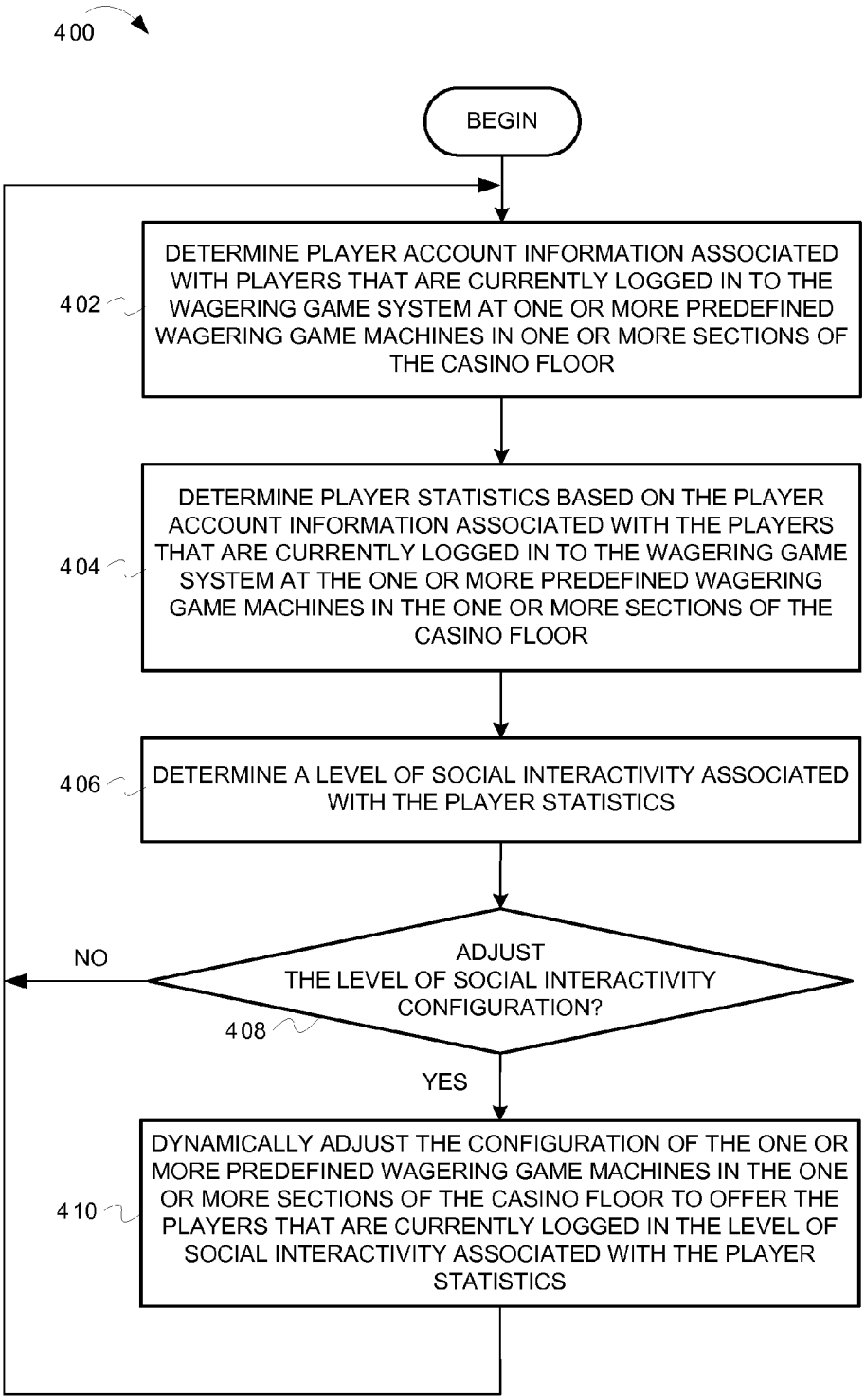
FIG. 4 is a flow diagram illustrating operations for dynamically changing the configuration of wagering game machines in a wagering game system to adjust the level of social interactivity that is offered to players, according to some embodiments.

FIG. 4 is a flow diagram ("flow") 400 illustrating operations for dynamically changing the configuration of wagering game machines in a wagering game system to adjust the level of social interactivity that is offered to players, according to some embodiments. The flow of 400 will be described with reference to the example system architecture of FIG. 2. The flow diagram begins at block 402.

At block 402, the wagering game server 250 determines player account information associated with players that are currently logged in to the wagering game system 200 at one or more predefined wagering game machines 260 in one or more sections of the casino floor. In one implementation, the player account unit 256 can identify the players that are logged in based on player card identification information or other type of login information that the players provided when logging in to the system, and/or by detecting the player accounts that are currently active. The player account unit 256 can access the player accounts of the players that are currently logged into the wagering game system 200 at one or more wagering game machines 260 in one or more sections of the casino. As described above, from the player accounts, the player account unit 256 can determine player account information, such as player demographics, player preferences, and/or player gaming activity. In some implementations, the player account unit 256 may be programmed to only analyze certain player account information. In one example, the player account unit 256 may be programmed to only analyze player demographics (e.g., age). In another example, the player account unit 256 may be programmed to only analyze age and player preferences. In other examples, the player account unit 256 may be programmed to analyze certain categories of player account information, and determine which type of player account information is available for analysis in a case-by-case basis.

In one example, the system configuration unit 258 may implement a default configuration that configures the casino floor at a first or default level of social interactivity, and then adjust the configuration as described herein (i.e., based on the player account information of the players that are currently logged in to the system 200). In another example, the system configuration unit 258 may implement the configurations schedule, determined based historical player account information (as described in FIG. 3), as the default configuration, and then adjust the configuration as described herein. It is noted, however, that the system configuration unit 258 may implement other default configurations for the casino floor; e.g., the system configuration unit 258 can implement a default configuration that configures e-table gaming machines at a second level of social interactivity and configures all other wagering game machines at a first level of social interactivity, and then adjusts the configuration as described herein.

In some embodiments, the wagering game server 250 can adjust the default level of social interactivity configuration at the one or more predefined wagering game machines 260 in one or more sections of the casino floor based on the players that are currently logged in. In one example, the one or more predefined wagering game machines 260 in the one or more sections of the casino floor can be a plurality of wagering game machines 260 in a first section of the casino floor that the casino operator wants to continuously monitor to determine whether to adjust the level of social interactivity. For example, the first section of the casino floor may be a section of the casino floor that includes wagering game machines 260 with relatively high minimum wager requirements (e.g., the "high roller" section of the casino floor). In another example, the first section of the casino floor may be a section with a relatively high concentration of multi-player wagering game machines 260 that offer two or more levels of social interactivity. In yet another example, the one or more predefined wagering game machines 260 in the one or more sections of the casino floor can be a group of e-table machines (with multi-player and multi-touch capabilities) at a first section of the casino floor, and another group of e-table machines at a second section of the casino floor, and/or two or more banks of related wagering game machines 260 (with multi-player bonus games) in two or more sections of the casino floor. In other embodiments, a plurality of predefined wagering game machines 260 at one or more sections of the casino floor can be monitored, but the process for determining whether to dynamically change the level of social interactivity can be determined for each predefined wagering game machine 260. The particular wagering game machines 260 at the one or more sections of the casino floor that are monitored to dynamically adjust the configuration for the level of social interactivity can be programmable (e.g., by the casino operator). After being programmed, the wagering game server 250 can dynamically adjust the configuration for the level of social interactivity at the one or more predefined wagering game machines 260 to provide a customized gaming experience that appeals to the players that are currently logged in to the wagering game system 200 via the one or more wagering game machines 260. After block 402, the flow continues at block 404.

At block 404, the wagering game server 250 determines player statistics based on the player account information associated with the players that are currently logged in to the wagering game system 200 at the one or more predefined wagering game machines 260 in the one or more sections of the casino floor. The player account unit 256 can determine player statistics in a similar manner as described above with reference to block 306 of FIG. 3, except that the player account unit 256 may only consider the player account information associated with the players that are currently logged in at the one or more predefined wagering game machines 260. In one example, based on the player account information obtained from the player accounts, the player account unit 256 can determine the average player age of the players that are currently logged in to the wagering game system 200 at the one or more predefined wagering game machines 260 in the one or more sections of the casino floor. The average age of the players can serve to indicate the level of social interactivity that is likely to appeal to these players. In another example, the player account unit 256 can determine the average age, and also player activity information, associated with the players that are currently logged in at the one or more predefined wagering game machines 260. Similarly as described above in block 306 of FIG. 3, the player account unit 256 can determine a social interactivity point score, based on the average age point score and the player activity point score, to determine the level of social interactivity that should appeal to the players that are currently logged in at the one or more predefined wagering game machines 260. It is noted, however, that the player account unit 256 can determine the player statistics based on other player account information or other combinations of player account information using similar methods as described in FIGS. 3-4. After block 404, the flow continues at block 406.

At block 406, the wagering game server 250 determines a level of social interactivity associated with the player statistics. In one implementation, the system configuration unit 258 determines the level of social interactivity that should appeal to the players that are currently logged in at the one or more predefined wagering game machines 260 in the one or more sections of the casino floor based on the player statistics (e.g., the average age of the players, or the social interactivity point score). Similarly as described above with reference to block 308 of FIG. 3, when the player account unit 256 determines the average age of the players, the system configuration unit 258 can associate a first level of social interactivity with an average age of 61 years of age and above, a second level of social interactivity with an average age of between 41 and 60 years of age, and a third level of social interactivity with an average age of between 21 and 40 years of age. In another example, when the player account unit 256 determines the social interactivity point score, the system configuration unit 258 can associate a first level of social interactivity with a social interactivity point score between 1-3 points, a second level of social interactivity with a social interactivity point score between 4-7 points, and a third level of social interactivity with a social interactivity point score between 8-10 points. After block 406, the flow continues at block 408.

At block 408, the wagering game server 250 determines whether to dynamically adjust the level of social interactivity configuration at the predefined one or more wagering game machines 260 in the one or more sections of the casino floor. In one implementation, based on whether the level of social interactivity associated with the player statistics matches the current level of social interactivity, the system configuration unit 258 may determine whether to dynamically adjust the configuration at the predefined one or more wagering game machines 260 for the level of social interactivity that is offered to the players. For example, the player statistics may indicate that the configuration at the predefined one or more wagering game machines 260 should be dynamically adjusted from a first or nominal level of social interactivity to a second or enhanced level of social interactivity. In another example, the player statistics may indicate that the configuration at the predefined one or more wagering game machines 260 should be dynamically adjusted from a second or enhanced level of social interactivity to a first or nominal level of social interactivity. However, in some instances, the level of social interactivity associated with the player statistics matches the current level of social interactivity, and therefore the system configuration unit 258 determines to maintain the currently level of social interactivity configuration. In some embodiments, the system configuration unit 258 may keep a record of the current level of social interactivity being provided to players at each wagering game machine 260 in the wagering game system 200 to compare the current level of social interactivity to the level of social interactivity associated with the player statistics. In another embodiment, the configuration unit 258 may query each wagering game machine 260 to determine the current level of social interactivity. If the system configuration unit 258 determines that the level of social interactivity should not be changed, the flow loops back to block 402 to continue to perform the configuration check. In some embodiments, the wagering game server 250 can be programmed to perform the configuration check periodically (e.g., every 30 minutes, every hour, every two hours, etc.). If the system configuration unit 258 determines that the level of social interactivity should be changed, the flow continues to block 410.

At block 410, the wagering game server 250 dynamically adjusts the configuration of the one or more predefined wagering game machines located in the one or more sections of the casino floor to offer the players that are currently logged in the level of social interactivity associated with the player statistics. As described above, in one embodiment, the system configuration unit 258 can broadcast a configuration message to the one or more predefined wagering game machines 260 to dynamically adjust the level of social interactivity. The configuration message can include an indication of the level of social interactivity associated with the player statistics. In one example, in response to receiving the configuration message, the one or more predefined wagering game machines 260 adjust the level of social interactivity that is offered to players by loading a different set of configuration files and/or changing a variable in the game code associated with the wagering games to enable or disable certain social interactivity features. Some examples social interactivity features that can be enabled or disabled by changing the level of social interactivity configuration will be described further below in the additional example embodiments section. In another embodiment, in addition to a configuration message, the system configuration unit 258 can send configuration files, game assets, and/or other game content if the wagering games need to be updated to allow the change in the level of social interactivity. After block 410, the flow loops back to block 402 to continue to perform the configuration check periodically, as programmed (e.g., every 30 minutes, every hour, every two hours, etc.). In some embodiments, instead of programming the wagering game server 250 to perform the configuration check process described above periodically, the wagering game server 250 may determine the turnover percentage of players in the one or more sections of the casino floor. The turnover percentage of players may include the number of players that have logged off and the number of new players that have logged in to the wagering game system 200 in the one or more sections of the casino floor since the last configuration check. In one example, if the turnover percentage is greater than a turnover percentage threshold, the wagering game server 250 performs the configuration check process, described above with reference to FIG. 4, to determine whether to change the level of social interactivity. For example, if the turnover percentage threshold is 10%, and the turnover percentage that was detected is 1%, the wagering game server 250 will wait to perform the configuration check process. However, if the detected turnover percentage is 20%, then the wagering game server 250 will perform the configuration check. In some embodiments, the wagering game server 250 can implement both periodic configuration checks and also configuration checks based on the turnover percentage.

In some embodiments, for both the processes described in FIGS. 3-4, if the system configuration unit 258 determines that the level of social interactivity should be changed, the system wagering game unit 258 changes the configuration at the wagering game machines 260 regardless of whether the machine are active or idle. If a wagering game machine 260 is active (i.e., players are logged in at the wagering game machine 260), the system configuration unit 258 may cause the wagering game machine 260 to present a notification screen on the display of the wagering game machine 260 informing the players that the level of social interactivity has been changed (and provide information about the specific social interactivity features that have been enabled or disabled). In one example, the wagering game machine 260 may wait until the current round of the wagering game has been completed before changing the configuration and notifying the players. In another example, if the wagering game machine 260 is active, the system configuration unit 258 may ask the players whether they want to override the configuration change. For example, in a multi-player machine, the players can vote whether to allow the configuration change. If the wagering game machine 260 is idle, the system configuration unit 258 changes the level of social interactivity configuration without displaying a notification screen.

Figure 6:
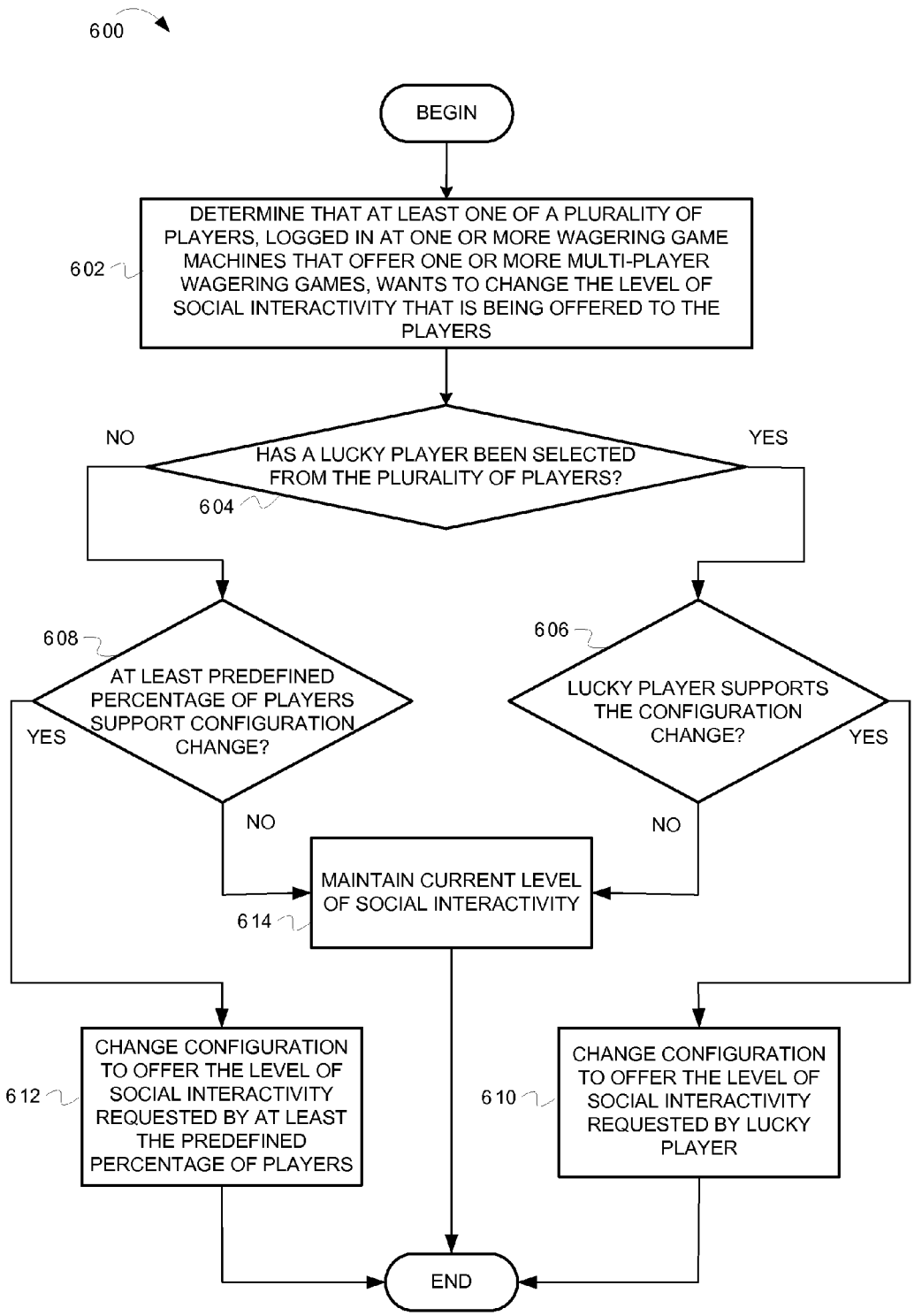
FIG. 6 is a flow diagram illustrating operations for adjusting the level of social interactivity offered by wagering game machines based on input from players, according to some embodiments.

FIG. 6 is a flow diagram ("flow") 600 illustrating operations for adjusting the level of social interactivity offered by wagering game machines based on input from players, according to some embodiments. The flow of 600 will be described with reference to the example system architecture of FIG. 2. The flow diagram begins at block 602.

At block 602, the wagering game server 250 determines that at least one of a plurality of players, which are logged in at one or more wagering game machines 260 of the wagering game system 200, wants to change the level of social interactivity that is being offered to the players at the one or more wagering game machines 260. In one embodiment, the system configuration unit 258 can cause a configuration screen to be presented on each of the displays of the one or more wagering game machines 260 to allow each of the players to select a desired level of social interactivity. In one example, the configuration screen may first ask each player whether the player wants a change in the level of social interactivity, and then ask each player to select the desired level of social interactivity. The configuration screen can be presented in the display of one or more related wagering game machines. For example, the configuration screen can be presented to all the players that are currently logged in at a single table wagering game machines. In another example, the configuration screen can be presented to all the players in a plurality of adjacent wagering game machines in a section of the casino floor. In yet another example, the configuration screen can be presented to all the players in one or more related banks of wagering game machines. In one embodiment, one or more players that are currently logged in at the one or more related wagering game machines 260 can trigger the presentation of the configuration screen. For example, after playing a few rounds of the wagering game, one or more of the players may want a higher level of social interactivity. In this example, the players may select a menu option or press a button to trigger the configuration screen in the displays of the one or more related wagering game machines 260. After receiving the player input, the one or more related wagering game machines 260 provide the configuration change request to the system configuration unit 258. After block 602, the flow continues at block 604.

At block 604, the system configuration unit 258 determines whether a lucky player has been selected at the one or more wagering game machines 260. In one example, the lucky player can be one of the plurality of players at the one or more wagering game machines that has been randomly selected (e.g., by the game management unit 252) to have the privileged of making certain decisions and selections during game play for the rest of the players. The lucky player may also receive other benefits, such as extra bonus points, extra spins, etc. In another example, the lucky player may be selected non-randomly; for example, the game management unit 252 may select the lucky player based on player gaming activity (e.g., coin-in). In some examples, a new lucky player may be selected periodically (e.g., every 20 minutes). In other examples, the current lucky player may maintain the lucky player designation by consistently winning for the group of players, or may be voted out by the group of players. If a lucky player has been selected, the flow continues at block 606. If a lucky player has not been selected, the flow continues at block 608.

At block 606, the system configuration unit 258 determines whether the luck player supports the change in level of social interactivity configuration. In one embodiment, one of the privileges of the lucky player can be deciding the level of social interactivity for the rest of the players in the one or more wagering game machines 260. For example, a lucky player can be designated for each table wagering game machine, and that lucky player can decide the level of social interactivity configuration for the table wagering game machine. In another example, a single lucky player can be assigned for multiple wagering game machines. For example, a single lucky player can be assigned for one or more banks of related wagering game machines. Also, a single lucky player can be assigned for two or more adjacent table wagering game machines. If the lucky player supports the configuration change, the flow continues at block 610. Otherwise, the flow continues at block 614.

At block 608, the system configuration unit 258 determines whether at least a predefined percentage of the plurality of players that are logged in at the one or more wagering game machines 260 support the change in level of social interactivity configuration. For example, the system configuration unit 258 determines whether at least 50% of the plurality of players support the configuration change. It is noted, however, that in other examples the predefined percentage can be other values (e.g., 51% or 75%). In one example, players that didn't provide an input for the configuration change may be counted as if they voted against the configuration change. In another example, the system configuration unit 258 may determine whether a predefined percentage of players support the configuration change out of the number of players that did provide input for the configuration change. If at least the predefined percentage of players support the configuration change, the flow continues at block 612. Otherwise, the flow continues at block 614.

At block 610, the system configuration unit 258 changes the configuration of the one or more wagering game machines to offer the level of social interactivity requested by the lucky player. After block 610, the flow ends.

At block 612, the system configuration unit 258 changes the configuration of the one or more wagering game machines to offer the level of social interactivity requested by at least the predefined percentage of players that are logged in at the one or more wagering game machines 260. After block 612, the flow ends.

At block 614, the system configuration unit 258 detects that either the lucky player does not support the configuration change, or that less than the predefined percentage of players supported the configuration change. Therefore, the system configuration unit 258 maintains the current level of social interactivity at the one or more wagering game machines 260. After block 614, the flow ends.

In some embodiments, the wagering game system can include a plurality of kiosks that include a social interactivity application that can be used by players to change the level of social interactivity (or suggest a change) of certain wagering game machines, or certain groups of wagering game machines in one or more sections of the casino floor.

In some embodiments, the system configuration unit 258 can maintain a record of the players that have requested a configuration change and the level of social interactivity that the players selected for the configuration change request. The system configuration unit 258 can learn player preferences (and update player accounts) based on the player input selecting a desired level of social interactivity. In some embodiments, this player preference information can be used in the process described above in FIG. 3 to determine whether to dynamically change the level of social interactivity of one or more wagering game machines 260 in the casino floor based on the players that are currently logged at the one or more wagering game machines 260.

In other embodiments, similar to the level of social interactivity, the wagering game server 250 can automatically adjust the minimum denomination requirements at one or more wagering game machines 260 in one or more sections of the casino floor based on players statistics. Furthermore, in some embodiments, the players at each wagering game machine can also suggest a change in the minimum denomination required at the wagering game machine.

It is noted that, in some embodiments, in addition to dynamically changing the configuration of one or more wagering game machines in one or more sections of the casino floor, and allowing players to change (or indicate they want to change) the level of social interactivity, the casino operator can change the configuration of one or more wagering game machines in one or more sections of the casino floor, as desired. For example, the casino operator can access the historical player account information and the historical player statistics associated with players that logged in to the system in the past (as determined in blocks 302-306 of FIG. 3) and manually configure the level of social interactivity based on this information (e.g., via a user interface to the system configuration unit 258). The casino operator can also access the configuration schedule (as determined in block 308 of FIG. 3) and manually adjust the configuration schedule as desired (e.g., based on the historical player account information and/or the historical player statistics). In another example, the casino operator can access the player account information and the player statistics associated with players that are currently logged in to the system (as determined in blocks 402-404 of FIG. 4), which can be continually updated in real-time, and manually configure the level of social interactivity based on this information.

Additional Example Embodiments

According to some embodiments, the wagering game machines 260 of the wagering game system 200 may offer various types of social interactivity features and opportunities between players while the players play various types of wagering games. The wagering game server 250 may adjust the level of social interactivity that is offered to players at the wagering game machines 260 by changing the configuration of the wagering game machines 260, as was described above with reference to FIGS. 1-6. The following non-exhaustive list enumerates some additional examples of various types of social interactivity features and opportunities that can be offered to players at the wagering game machines 260 while playing various types of wagering games.

In one embodiment, one or more wagering game machines 260 can be configured to offer two or more levels of social interactivity in one or more community group bonus game. For example, for a picking bonus game, an e-table gaming machine can be configured to offer either a first or default level of social interactivity, or a second or enhanced level of social interactivity depending on a configuration message received from the wagering game server 250 (as was described above with reference to FIGS. 1-5). In one implementation, when configured to offer the second level of social interactivity, the e-table gaming machine may present a matrix of picking elements at the center of the table display so that all the players have access to a common field of picking elements. Also, an enhanced social interactivity feature can be enabled that allows players to swap or trade picking elements. For example, player A may want to trade for the lucky horseshoe that player B picked from the matrix of picking elements. Another enhanced social interactivity feature can be enabled that allows players to combine picking elements (from one or more players) to win additional bonus points. When configured to offer the first level of social interactivity, the e-table gaming machine can present a separate matrix of picking elements to each player. For example, the e-table gaming machine can present the matrix of picking elements at the center of the table display, but the matrix can be divided into zones and each player can just picking elements from their respective zone. Furthermore, the social interactivity feature of swapping or trading or combining picking elements may not be enabled for the first level of social interactivity. It is noted, however, that although in this example (and the other examples described herein) this concept is described as being implemented on an e-table gaming machine, the enhanced social interactivity feature of presenting a common matrix of picking elements can also be implemented on a bank of related wagering game machines 260. For example, the common matrix of picking elements can be displayed on a second or top display of each of the wagering game machines in the bank.

In another embodiment, one or more wagering game machines 260 can be configured to offer an enhanced social interactivity feature or opportunity that shares a big win (e.g., from a bonus game) with all the players at the table gaming machine, or bank of wagering game machines, or even in adjacent wagering game machines. In one implementation, when an e-table gaming machine is configured to offer a second level of social interactivity, if a player on the e-table wins an award that is larger than a predefined award amount (i.e., a "big win"), the player wins a predefined percentage of the award amount (e.g., 80%), and the rest of the award amount (e.g., 20%) is shared equally with the other players at the e-table. In another implementation, the award amount is shared with the other players at the same e-table, and also with the players at adjacent e-tables. For example, 80% of the award amount can be awarded to the player that won the award at the first e-table, 10% of the award amount can be shared with the other players at the first e-table, 6% of the award can be shared with the players at a first group of e-tables that are adjacent to the first e-table, and 4% of the award can be shared with the players at a second group of e-tables that are adjacent to the first group of e-tables. In other words, a percentage of the award can be radiated from the wagering game machine where the award was triggered to multiple levels of adjacent or proximal wagering game machines. The percentage of the award that is shared is decreased for each level of adjacent or proximal wagering game machines (i.e., the closest group of adjacent machines receive a higher percentage than the farthest group of proximal wagering game machines). In some embodiments, the award that is shared with adjacent or proximal wagering game machines can be based on other factors, such as gaming machine occupancy, gaming machine average coin-in, etc. For example, the higher the occupancy (or average coin-in) of an adjacent wagering game machine, the higher the award that will be shared with that machine. In some implementations, the award that is radiated from the winning wagering game machine to the adjacent wagering game machines can be a percentage of a community group bonus award that was won by all the players at the winning wagering game machine. In other implementations, the displays of the multiple levels of adjacent e-tables can be combined when a particular type of bonus game is triggered at any one of the e-tables. For example, the displays can be combined to play a "hot potato" style game, where one of the e-tables wins (if the "hot potato" lands of the e-table) a predefined percentage of the bonus award amount (e.g., 80%) and the rest (e.g., 20%) is radiated and shared among the rest of the e-tables. In another example, the displays can be combined to play a bonus round of a slots game, and all the e-tables share equally in the winnings When the wagering game machines are configured to offer a first level of social interactivity, the wagering game machines would not share the bonus award amount with adjacent wagering game machines and the bonus games with combined displays would not be triggered.

In another embodiment, when the wagering game system 200 allows players to play wagering games via mobile gaming devices (e.g., dedicated mobile gaming devices, tablet computers, mobile phones, etc.), the wagering game system 200 can also adjust the level of social interactivity associated with the mobile gaming devices. In one implementation, when the casino floor (including the mobile gaming devices) is configured to offer a first level of social interactivity, the mobile gaming devices can just offer players the option to play certain individual wagering games on the mobile gaming device, and/or the option to play community group bonus games with a lesser degree of social interactivity with other players. When the casino floor (or certain sections of the casino floor) and the mobile gaming devices are configured to offer a second or enhanced level of social interactivity, the players can walk up to an e-table gaming machine (or a bank of wagering game machines) and join the wagering games being played at the e-table. In addition to providing mobility to the player, this can allow communal wagering game machines that are full to expand the number of players that can participate in the wagering games. In some implementations, the existing players at the e-table gaming machine can vote on whether to allow the player on the mobile gaming machine to join depending on whether the player can help the e-table win more bonus points during bonus rounds. For example, the player that wants to join via the mobile gaming device can try to join, and at the same time communicate to the e-table that the player has previously earned a rare bonus game accessory/asset, or a status trophy, which increases the payout in the bonus game, provides extra free spins or free rounds in the bonus game, and/or provides extra bonus game opportunities. In some examples, the bonus game accessories or status trophies of the player on the mobile gaming device can combine with the bonus game accessories and status trophies of the existing players at the e-table to offer similar benefits (or additional benefits) during the bonus rounds. In other implementations, the existing players at the e-table gaming machine can be offered additional social interactivity features and opportunities, and/or additional bonus game benefits, if the existing players at the e-table allow the player on the mobile gaming device to join.

In another embodiment, the casino floor may include one or more table gaming machines, each including a primary table display and a plurality of retractable screens (e.g., LCD screens). In one implementation, when the table gaming machine is configured to offer a first level of social interactivity, the retractable screens will be raised and the players would use the retractable screens to play the wagering games and provide player input. When the table gaming machine is configured to offer a second or enhanced level of social interactivity, the retractable screens would be lowered and the players would use the main table display to play the wagering games and to provide player input. In some implementations, the retractable screens would only be lowered to provide enhanced social interactivity features and opportunities during bonus games. In some embodiments, at least a subset of the retractable screens can include parallax barriers, which can display different images from the same monitor to different viewing angles. In this manner, the main display for a player can also function as a secondary display to an adjacent player when enabled.

In another embodiment, an electronic table gaming machine that allows multiple players to play wagering games can be configured to include a display (e.g., a table top display, retractable screen, etc.) at every other player location. In one example, this configuration of e-table can be used to allow couples to play wagering games that are specifically designed for two players, or other types of wagering games that can be played with teams of two players. In some embodiments, the functionality to allow two players to play together can be enabled when the e-table is providing an enhanced level of social interactivity. Although, as described above, in some implementations, the players can also enable this enhanced level of social interactivity option. In some embodiments, the e-table can be dynamically configured to allow a subset of the player locations to play as couples and the remaining subset of the player locations to play as single players.

In another embodiment, the wagering game server 250 can randomly select a "lucky player" from the players in a single wagering game machine (e.g., e-table gaming machine), or a group of wagering game machines (e.g., a bank of related wagering game machines), and provide certain privileges to the lucky player (e.g., selection privileges, bonus points, etc.), as was described above. In some implementations, when the wagering game machines 260 in a certain section of the casino floor are configured to offer a second or enhanced level of social interactivity, the players that are seated closest to the lucky player (e.g., at the same table, bank of machines, or in adjacent machines) can also receive some benefits. For example, players that are seated at the same e-table as the lucky player can receive increased probability of winning in the base game, extra bonus points, increased bonus multipliers, etc. Also, players that are playing at adjacent wagering game machines may receive some benefits, but not at the level of the players that are at the same wagering game machine. In some implementations, the perceived level of social interactivity can also be modified by changing the audio/visual presentation at the wagering game machines. For example, the lighting at the wagering game machine where the lucky player is playing can be changed (e.g., to a red color), and the volume of the sound effects or the type of sound effects can be enhanced. In other embodiments, the wagering game machines 260 in the section of the casino floor can also offer an enhanced social interactivity opportunity that involves dividing the players and gaming machines in the section of the casino floor into two or more teams (e.g., to play team based slot tournaments). In one example, the team that wins the most bonus points (or combined base and bonus points) in a predefined amount of time (e.g., 15 minutes) can win additional bonus points, extra bonus game opportunities, or enabled functionality of hardware devices such as extra buttons, chair feedback/haptics, or peripheral devices to turn on (such as mobile gaming devices), etc.

Additional Example Operating Environments

This section describes example operating environments, systems and networks, and presents structural aspects of some embodiments.

Wagering Game Machine Architecture

Figure 7:
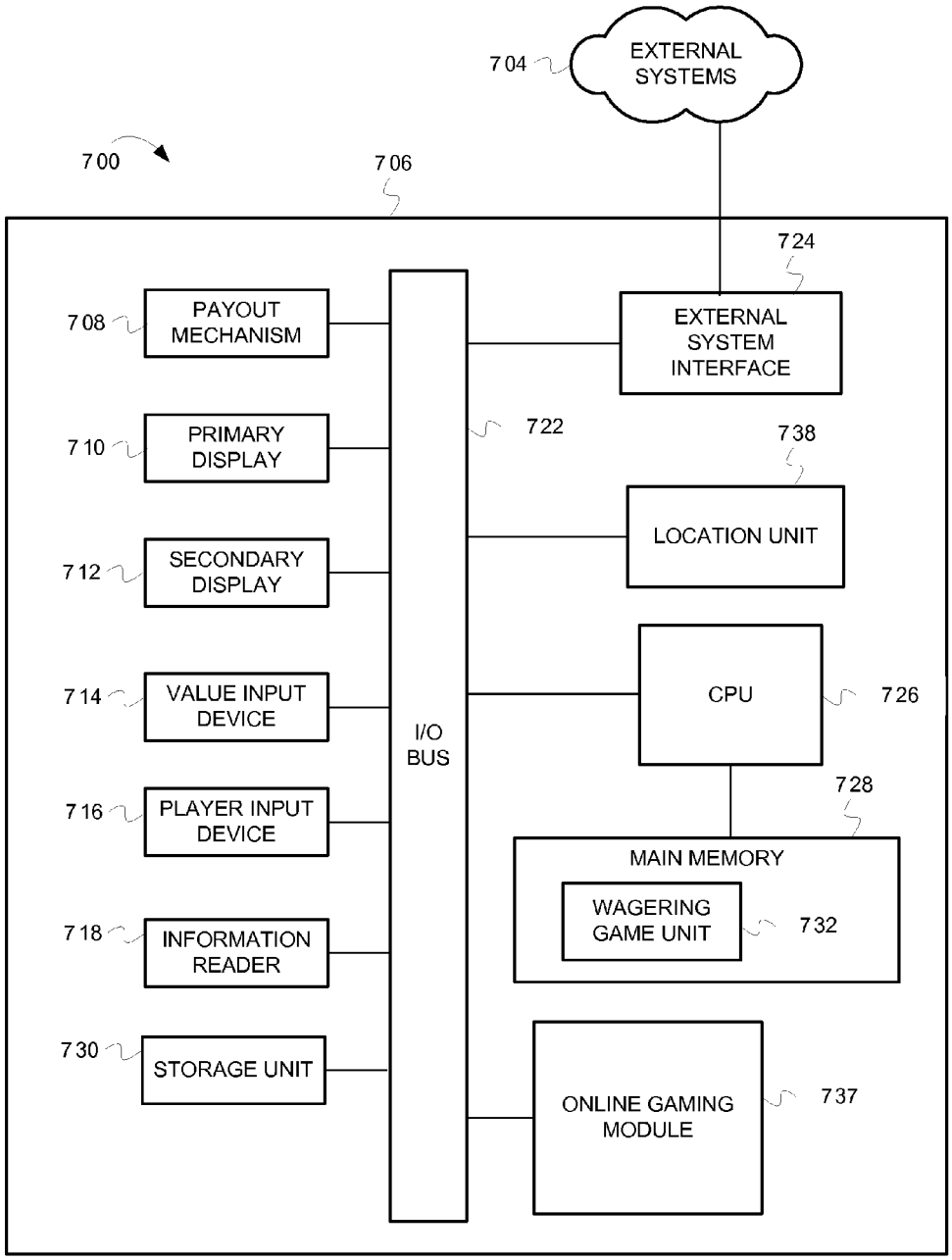
FIG. 7 is a conceptual diagram that illustrates an example of a wagering game machine architecture, according to some embodiments.

FIG. 7 is a conceptual diagram that illustrates an example of a wagering game machine architecture 700, according to some embodiments. In FIG. 7, the wagering game machine architecture 700 includes a wagering game machine 706, which includes a central processing unit (CPU) 726 connected to main memory 728. The CPU 726 can include any suitable processor, such as an Intel® Pentium processor, Intel® Core 2 Duo processor, AMD Opteron™ processor, or UltraSPARC processor. The main memory 728 includes a wagering game unit 732. In some embodiments, the wagering game unit 732 can present wagering games, such as video poker, video black jack, video slots, video lottery, reel slots, etc., in whole or part. The wagering game unit 732 may also facilitate the process for changing the configuration of the wagering game machine 706 to adjust the level of social interactivity that is offered to players, e.g., as described above with reference to FIGS. 1-6.

The CPU 726 is also connected to an input/output ("I/O") bus 722, which can include any suitable bus technologies, such as an AGTL+frontside bus and a PCI backside bus. The I/O bus 722 is connected to a payout mechanism 708, primary display 710, secondary display 712, value input device 714, player input device 716, information reader 718, and storage unit 730. The player input device 716 can include the value input device 714 to the extent the player input device 716 is used to place wagers. The I/O bus 722 is also connected to an external system interface 724, which is connected to external systems 704 (e.g., wagering game networks). The external system interface 724 can include logic for exchanging information over wired and wireless networks (e.g., 802.11g transceiver, Bluetooth transceiver, Ethernet transceiver, etc.)

The I/O bus 722 is also connected to a location unit 738. The location unit 738 can create player information that indicates the wagering game machine's location/movements in a casino. In some embodiments, the location unit 738 includes a global positioning system (GPS) receiver that can determine the wagering game machine's location using GPS satellites. In other embodiments, the location unit 738 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 7, in some embodiments, the location unit 738 is not connected to the I/O bus 722.

In some embodiments, the wagering game machine 706 can include additional peripheral devices and/or more than one of each component shown in FIG. 7. For example, in some embodiments, the wagering game machine 706 can include multiple external system interfaces 724 and/or multiple CPUs 726. In some embodiments, any of the components can be integrated or subdivided.

In some embodiments, the wagering game machine 706 includes an online gaming module 737. The online gaming module 737 can process communications, commands, or other information, where the processing can control and present online wagering games. In some embodiments, the online gaming module 737 can work in concert with the wagering game unit 732, and can perform any of the operations described above.

Furthermore, any component of the wagering game machine 706 can include hardware, firmware, and/or machine-readable storage media including instructions for performing the operations described herein.

Example Wagering Game Machines

Figure 8:
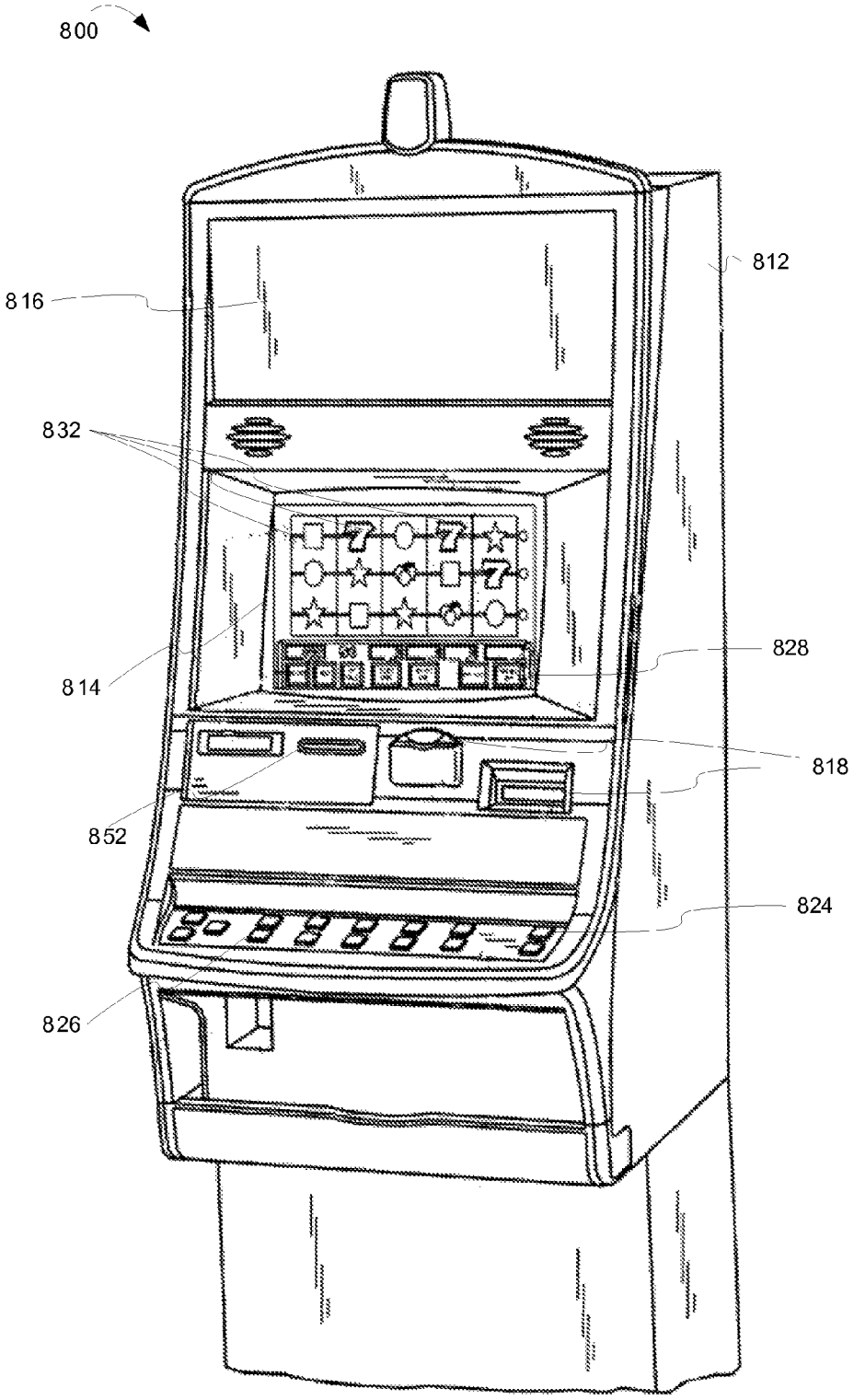
FIG. 8 is a perspective view of a wagering game machine, according to example embodiments.

FIG. 8 is a perspective view of a wagering game machine, according to example embodiments. Referring to FIG. 8, a wagering game machine 800 is used in gaming establishments, such as casinos. In some embodiments, the wagering game machine 800 can implement some of the functionality described above for facilitating the process for changing the configuration of the wagering game machine 800 to adjust the level of social interactivity that is offered to players, e.g., as described above with reference to FIGS. 1-7.

According to embodiments, the wagering game machine 800 can be any type of wagering game machine and can have varying structures and methods of operation. For example, the wagering game machine 800 can be an electromechanical wagering game machine configured to play mechanical slots, or it can be an electronic wagering game machine configured to play video casino games, such as blackjack, slots, keno, poker, blackjack, roulette, etc.

The wagering game machine 800 comprises a housing 812 and includes input devices, including value input devices 818 and a player input device 824. For output, the wagering game machine 800 includes a primary display 814 for displaying information about a basic wagering game. In some implementations, the primary display 814 can also display information about a bonus wagering game and a progressive wagering game. The wagering game machine 800 also includes a secondary display 816 for displaying bonus wagering games, wagering game events, wagering game outcomes, and/or signage information. While some components of the wagering game machine 800 are described herein, numerous other elements can exist and can be used in any number or combination to create varying forms of the wagering game machine 800.

The value input devices 818 can take any suitable form and can be located on the front of the housing 812. The value input devices 818 can receive currency and/or credits inserted by a player. The value input devices 818 can include coin acceptors for receiving coin currency and bill acceptors for receiving paper currency. Furthermore, the value input devices 818 can include ticket readers or barcode scanners for reading information stored on vouchers, cards, or other tangible portable storage devices. The vouchers or cards can authorize access to central accounts, which can transfer money to the wagering game machine 800.

The player input device 824 comprises a plurality of push buttons on a button panel 826 for operating the wagering game machine 800. In addition, or alternatively, the player input device 824 can comprise a touch screen 828 mounted over the primary display 814 and/or secondary display 816.

The various components of the wagering game machine 800 can be connected directly to, or contained within, the housing 812. Alternatively, some of the wagering game machine's components can be located outside of the housing 812, while being communicatively coupled with the wagering game machine 800 using any suitable wired or wireless communication technology.

The operation of the basic wagering game can be displayed to the player on the primary display 814. The primary display 814 can also display a bonus game associated with the basic wagering game. The primary display 814 can include a cathode ray tube (CRT), a high resolution liquid crystal display (LCD), a plasma display, light emitting diodes (LEDs), or any other type of display suitable for use in the wagering game machine 800. Alternatively, the primary display 814 can include a number of mechanical reels to display the outcome. In FIG. 8, the wagering game machine 800 is an "upright" version in which the primary display 814 is oriented vertically relative to the player. Alternatively, the wagering game machine can be a "slant-top" version in which the primary display 814 is slanted at about a thirty-degree angle toward the player of the wagering game machine 800. In yet another embodiment, the wagering game machine 800 can exhibit any suitable form factor, such as a free standing model, bartop model, mobile handheld model, electronic table gaming machine model, or workstation console model.

A player begins playing a basic wagering game by making a wager via the value input device 818. The player can initiate play by using the player input device's buttons or touch screen 828. The basic game can include arranging a plurality of symbols along a payline 832, which indicates one or more outcomes of the basic game. Such outcomes can be randomly selected in response to player input. At least one of the outcomes, which can include any variation or combination of symbols, can trigger a bonus game.

In some embodiments, the wagering game machine 800 can also include an information reader 852, which can include a card reader, ticket reader, bar code scanner, RFID transceiver, or computer readable storage medium interface. In some embodiments, the information reader 852 can be used to award complimentary services, restore game assets, track player habits, etc.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A computer-implemented method comprising:

determining, at a wagering game server of a wagering game system, player account information associated with a plurality of players that are logged in at one or more wagering game machines of the wagering game system, wherein the player account information indicates a first level of social interactivity;

determining, at the wagering game server, that a current level of social interactivity being provided during game play to the plurality of players is different than the first level of social interactivity; and changing a configuration of the one or more wagering game machines to provide during game play to the plurality of players the first level of social interactivity.

2. The computer-implemented method of claim 1, wherein the first level of social interactivity is determined by operations comprising:

determining, at the wagering game server, player statistics based on the player account information associated with the plurality of players;

determining, at the wagering game server, the first level of social interactivity associated with the player statistics; and determining, at the wagering game server, to provide the first level of social interactivity associated with the player statistics during game play to the plurality of players.

3. The computer-implemented method of claim 2, wherein said determining player statistics based on the player account information associated with the plurality of players and said determining the first level of social interactivity associated with the player statistics comprise:

determining, at the wagering game server, a point score for each of one or more categories of the player account information associated with the plurality of players;

determining, at the wagering game server, a social interactivity point score based on the point score for each of the one or more categories of the player account information; and determining, at the wagering game server, the first level of social interactivity associated with the social interactivity point score.

4. The computer-implemented method of claim 3, wherein the one or more categories of the player account information associated with the plurality of players comprises one or more of player demographic information, player preference information, and player gaming activity information associated with the plurality of players.

5. The computer-implemented method of claim 1, wherein said changing the configuration of the one or more wagering game machines to provide during game play to the plurality of players the first level of social interactivity comprises providing, via a communication network, a configuration message from the wagering game server to the one or more wagering game machines to cause the one or more wagering game machines to change a social interactivity configuration to provide during game play to the plurality of players the first level of social interactivity.

6. The computer-implemented method of claim 1, wherein said determining the player account information associated with the plurality of players that are logged in at the one or more wagering game machines of the wagering game system comprises:

identifying, at the wagering game server, a plurality of player accounts associated with the plurality of players that are logged in at the one or more wagering game machines of the wagering game system; and determining, at the wagering game server, the player account information from the plurality of player accounts associated with the plurality of players.

7. The computer-implemented method of claim 1, wherein the one or more wagering game machines of the wagering game system include one or more electronic table gaming machines in one or more sections of a casino floor of the wagering game system that are configured to provide one of multi-player base and bonus games, and configured to provide two or more levels of social interactivity during game play.

8. The computer-implemented method of claim 1, further comprising:

determining, at the wagering game server, that one or more of a plurality of players that are logged in at one of the wagering game machines of the wagering game system want to change the current level of social interactivity that is being provided to the plurality of players during game play at the wagering game machine;

causing one or more of the wagering game machine to present a plurality of configuration windows on one or more displays to allow each of the plurality of players to enter configuration input indicating whether one or more players wants to change the current level of social interactivity and a desired level of social interactivity;

receiving, at the wagering game server, the configuration input entered by the plurality of players from the wagering game machine;

determining whether at least a predefined percentage of the plurality of players want to change the current level of social interactivity that is being provided to the plurality of players during game play at the wagering game machine;

in response to determining that at least the predefined percentage of the plurality of players want to change the current level of social interactivity, changing a configuration of the wagering game machine to provide during game play to the plurality of players the desired level of social interactivity; and in response to determining that less than the predefined percentage of the plurality of players want to change the current level of social interactivity, maintaining the configuration of the wagering game machine to continue to provide during game play to the plurality of players the current level of social interactivity.

9. The computer-implemented method of claim 1, further comprising:

determining that a plurality of players at a first wagering game machine of the plurality of wagering game machines won a bonus game award that is greater than a predefined award amount;

determining that the plurality of wagering game machines are configured to provide an enhanced level of social interactivity;

determining that the bonus game award won by the plurality of players at the first wagering game machine is to be shared with a plurality of adjacent wagering game machines of the plurality of predefined wagering game machines based, at least in part, on the enhanced level of social interactivity configuration of the plurality of wagering game machines;

determining a percentage of the bonus game award to provide to the plurality of players at the first wagering game machine;

identifying the plurality of adjacent wagering game machines to the first wagering game machine; and determining a remaining percentage of the bonus game award to distribute across the plurality of adjacent wagering game machines.

10. The computer-implemented method of claim 9, wherein said determining the remaining percentage of the bonus game award to distribute among the plurality of adjacent wagering game machines is based on at least one of proximity of each of the adjacent wagering game machines to the first wagering game machine, occupancy of each of the adjacent wagering game machines, and average player wagers associated with each of the adjacent wagering game machines.

11. The computer-implemented method of claim 1, further comprising:

determining that a first player is logged in to a mobile wagering game machine of the wagering game system and is attempting to join a multi-player wagering game machine of the wagering system that is configured to provide an enhanced level of social interactivity;

determining first player account information associated with the first player, wherein the first player account information comprises one or more of gaming related achievements, assets, and awards;

causing the multi-player wagering game machine to present the first player account information associated with the first player to a plurality of players at the multi-player wagering game machine;

determining whether at least a predefined percentage of the plurality of players indicate to allow the first player to join the multi-player wagering game machine based on the first player account information;

in response to determining that at least the predefined percentage of the plurality of players indicate to allow the first player to join;

causing the multi-player wagering game machine to allow the first player to join the multi-player wagering game machine via the mobile wagering game machine;

in response to determining that less than the predefined percentage of the plurality of players do not indicate to allow the first player to join;

causing the mobile wagering game machine to present to the first player an indication that the player cannot join the multi-player wagering game machine via the mobile wagering game machine.

12. A computer-implemented method comprising:

determining, at a wagering game server of a wagering game system, historical player account information associated with players that logged in to the wagering game system in the past during a predefined period of time;

determining, at the wagering game server, a configuration schedule for changing a level of social interactivity that is provided during game play to players that log in at a plurality of wagering game machines of the wagering game system based, at least in part, on the historical player account information; and changing a configuration of the plurality of wagering game machines for the level of social interactivity that is provided during game play to players that log in at the plurality of wagering game machines according to the configuration schedule.

13. The computer-implemented method of claim 12, wherein said determining the configuration schedule for changing the level of social interactivity that is provided during game play to the players that log in at the plurality of wagering game machines of the wagering game system based, at least in part, on the historical player account information comprises:

sorting, at the wagering game server, the historical player account information associated with the players according to a time and day of week each player logged in to the wagering game system in the past during the predefined period of time;

determining, at the wagering game server, historical player statistics based on the historical player account information sorted according to the time and day of the week each player logged in to the wagering game system in the past during the predefined period of time; and determining, at the wagering game server, the configuration schedule for changing the level of social interactivity that is provided during game play to the players that log in at the plurality of wagering game machines of the wagering game system based on the historical player statistics.

14. The computer-implemented method of claim 13, wherein said determining historical player statistics based on the historical player account information sorted according to the time and day of the week each player logged in to the wagering game system in the past during the predefined period of time and said determining the configuration schedule for changing the level of social interactivity comprise:

determining, at the wagering game server, the historical player statistics for each of a plurality of time periods for each day of the week based on the historical player account information sorted according to the plurality of time periods for each day of the week when each player logged in to the wagering game system in the past during the predefined period of time;

determining, at the wagering game server, a level of social interactivity associated with the historical player statistics for each of the plurality of time periods for each day of the week; and determining, at the wagering game server, the configuration schedule indicating whether to change the level of social interactivity during each of the plurality of time periods for each day of the week based on the level of social interactivity associated with the historical player statistics for each of the plurality of time periods for each day of the week.

15. The computer-implemented method of claim 14, wherein the historical player account information associated with the players comprises one or more of player demographic information, player preference information, and player gaming activity information associated with players.

16. The computer-implemented method of claim 12, wherein said changing the configuration of the plurality of wagering game machines for the level of social interactivity that is provided during game play to the players that log in at the plurality of wagering game machines according to the configuration schedule comprises:

determining, at the wagering game server, a current time and day of week;

determining, at the wagering game server, for the current time and day of the week whether to change the configuration of the plurality of wagering game machines for the level of social interactivity that is provided during game play to the players that log in at the plurality of wagering game machines according to configuration schedule; and in response to determining that according to the configuration schedule that for the current time and day of the week the configuration should be changed, providing a configuration message, via a communication network, from the wagering game server to the plurality of wagering game machines to cause the plurality of wagering game machines to change the level of social interactivity that is provided during game play to the players that log in at the plurality of wagering game machines.

17. The computer-implemented method of claim 12, wherein said determining the historical player account information associated with the players that logged in to the wagering game system in the past during the predefined period of time comprises:

identifying, at the wagering game server, a plurality of player accounts associated with the players that logged in to the wagering game system in the past during the predefined period of time; and determining, at the wagering game server, the historical player account information from the plurality of player accounts associated with the players that logged in to the wagering game system in the past during the predefined period of time.

18. The computer-implemented method of claim 12, further comprising:

determining, at the wagering game server, player account information associated with a plurality of players that are logged in at one or more wagering game machines of the wagering game system;

determining, at the wagering game server, a desired level of social interactivity to provide during game play to the plurality of players based, at least in part, on the player account information associated with the plurality of players;

determining, at the wagering game server, that a current level of social interactivity, based on the configuration schedule, that is being provided during game play to the plurality of players is different than the desired level of social interactivity; and changing dynamically, a configuration of the one or more wagering game machines to provide during game play to the plurality of players the desired level of social.

19. A wagering game server of a wagering game system, the wagering game server comprising:

a player account unit configured to determine player account information associated with a plurality of players that are logged in at one or more wagering game machines of the wagering game system, and further configured to, determine player statistics based on the player account information associated with the plurality of players; and a system configuration unit configured to determine, based on the player statistics, a level of social interactivity to provide to the plurality of players during game play, and further configured to, determine that a current level of social interactivity being provided during game play to the plurality of players is different than the level of social interactivity associated with the player statistics, and change a configuration of the one or more wagering game machines to provide to the plurality of players during game play, plurality of players the level of social interactivity.

20. The wagering game server of claim 19, wherein the player account unit configured to determine player statistics based on the player account information associated with the plurality of players comprises the player account unit configured to:

determine a point score for each of one or more categories of the player account information associated with the plurality of players; and determine a social interactivity point score based on the point score for each of the one or more categories of the player account information.

21. The wagering game server of claim 20, wherein the system configuration unit configured to determine the level of social interactivity associated with the player statistics comprises the system configuration unit configured to:

determine the level of social interactivity associated with the social interactivity point score.

22. One or more non-transitory machine-readable storage media, having instructions stored therein, which, when executed by one or more processors causes the one or more processors to perform operations that comprise:

determining player account information associated with a plurality of players that are logged in at one or more wagering game machines of a wagering game system, wherein the player account information indicates a first level of social interactivity;

determining that a current level of social interactivity being provided during game play to the plurality of players is different than the first level of social interactivity; and changing a configuration of the one or more wagering game machines to provide during game play to the plurality of players the first level of social interactivity.

23. The one or more non-transitory machine-readable storage media of claim 22, wherein the first level of social interactivity is determined by operations comprising:

determining player statistics based on the player account information associated with the plurality of players;

determining the first level of social interactivity associated with the player statistics; and determining to provide the first level of social interactivity associated with the player statistics during game play to the plurality of players.

24. The one or more non-transitory machine-readable storage media of claim 23, wherein said operation of determining player statistics based on the player account information associated with the plurality of players and said operation of determining the first level of social interactivity associated with the player statistics comprise:

determining a point score for each of one or more categories of the player account information associated with the plurality of players;

determining a social interactivity point score based on the point score for each of the one or more categories of the player account information; and determining the first level of social interactivity associated with the social interactivity point score.

* * * * *